US011666188B2

(12) United States Patent
Yoo et al.

(10) Patent No.: US 11,666,188 B2
(45) Date of Patent: Jun. 6, 2023

(54) HOME APPLIANCE INCLUDING DRYER

(71) Applicant: LG ELECTRONICS INC., Seoul (KR)

(72) Inventors: Hyunsun Yoo, Seoul (KR); Jaehung Chun, Seoul (KR); Yousook Eun, Seoul (KR); Joogyeom Kim, Seoul (KR); Sungkyung Kim, Seoul (KR); Myongsun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 837 days.

(21) Appl. No.: 16/576,452

(22) Filed: Sep. 19, 2019

(65) Prior Publication Data

US 2020/0085259 A1 Mar. 19, 2020

Related U.S. Application Data

(60) Provisional application No. 62/733,478, filed on Sep. 19, 2018.

(30) Foreign Application Priority Data

Feb. 15, 2019 (KR) ..... 10-2019-0017596
Feb. 19, 2019 (KR) ..... 10-2019-0019327
Jul. 19, 2019 (KR) ..... 10-2019-0087781

(51) Int. Cl.
*A47K 10/48* (2006.01)

(52) U.S. Cl.
CPC ..... *A47K 10/48* (2013.01)

(58) Field of Classification Search
None
See application file for complete search history.

(56) References Cited

U.S. PATENT DOCUMENTS 4,910,385 A 3/1990 Shye-Long
6,491,267 B1 12/2002 Feldman
2002/0043003 A1 4/2002 Cruz
2004/0232790 A1* 11/2004 Mendenhall ..... H02K 41/03 310/112
2010/0307019 A1 12/2010 Park et al.
2013/0163197 A1 6/2013 Mack et al.

FOREIGN PATENT DOCUMENTS

CH 419480 A 8/1966
CN 101236349 A 8/2008
CN 101306673 A 11/2008
(Continued)

*Primary Examiner* — Jason Lau
(74) *Attorney, Agent, or Firm* — Birch, Stewart, Kolasch & Birch, LLP

(57) ABSTRACT

A home appliance including a dryer to discharge drying air and a stand is provided. The dryer includes a casing, a fan located in the casing, a heater located in the casing, a grip connected to the casing, and a dryer positioner located at the grip. The stand includes a receptacle to detachably mount an end of the grip of the dryer and a stand positioner located at the receptacle, the stand positioner cooperating with the dryer positioner when the grip is mounted in the receptacle to align the grip in a predetermined position. At least one of a magnetic force or a physical contact occurs between the dryer positioner and the stand positioner.

14 Claims, 19 Drawing Sheets

(56) References Cited

FOREIGN PATENT DOCUMENTS

| | | | |
|---|---|---|---|
| CN | 101808712 | A | 8/2010 |
| CN | 102467188 | A | 5/2012 |
| CN | 202992581 | U | 6/2013 |
| CN | 103348173 | A | 10/2013 |
| CN | 203517196 | U | 4/2014 |
| CN | 203688521 | U | 7/2014 |
| CN | 106061331 | A | 10/2016 |
| CN | 205640117 | U | 10/2016 |
| EP | 3 626 112 | A1 | 3/2020 |
| JP | 49-112755 | A | 10/1974 |
| JP | 7-221 | A | 1/1995 |
| JP | 10-132192 | A | 5/1998 |
| KR | 10-1383330 | B1 | 4/2014 |
| KR | 10-2015-0031643 | A | 3/2015 |
| KR | 20-2016-0002206 | U | 6/2016 |
| KR | 10-2018-0043526 | A | 4/2018 |
| TW | I590028 | B | 7/2017 |
| WO | WO 01/54536 | A1 | 8/2001 |

* cited by examiner (a) (b)

HOME APPLIANCE INCLUDING DRYER

CROSS REFERENCE TO RELATED APPLICATIONS

This application claims the priority benefit of U.S. Provisional Application No. 62/733,478, filed on Sep. 19, 2018, Korean Patent Application No. 10-2019-0017596, filed on Feb. 15, 2019, Korean Patent Application No. 10-2019-0019327, filed on Feb. 19, 2019, and Korean Patent Application No. 10-2019-0087781, filed on Jul. 19, 2019, the entire disclosures of all of which are hereby expressly incorporated by reference into the present application.

BACKGROUND OF THE DISCLOSURE

Field of the Disclosure

The present disclosure relates to a home appliance including a dryer for discharging drying air and a stand in which the dryer is mounted. More particularly, the present disclosure relates to a home appliance including a dryer capable of being positioned at a predetermined position on a stand when the dryer is mounted in the stand, and preventing the dryer from being separated from the stand unless a user intends to separate the dryer from the stand.

Description of the Related Art

When a dryer is used for drying an object, which may be a portion of a human body, a user generally holds the dryer and performs drying while moving the dryer toward the object.

In order to address an inconvenience in that the user typically performs drying while holding the dryer, a conventional stand capable of mounting the dryer has been proposed in the related art.

However, in the conventional stand, when the user wants to change a portion of an object to be dried, the user has to adjust a direction of the stand or move the object so that an air discharging direction of the dryer mounted in the stand faces the portion of the object to be dried.

In particular, when an object to be dried frequently changes position, such as when the object to be dried is an infant or a companion animal, it has been difficult to change an air discharge direction of the dryer mounted in a conventional stand.

In order to solve such a problem, US 2010/0307019 A1 discloses a structure that tilts a dryer mounted in a stand; however, because the dryer is integrally provided in the stand, the user still has a difficulty in directly carrying and holding the dryer and drying with the dryer.

Unlike the above-mentioned US 2010/0307019 A1, KR 20150031643 A and KR 20180043526 A disclose stands in which a dryer is detachably mounted and a height and angle of the dryer may be adjusted. However, a configuration for positioning the dryer at a predetermined position on the stand and a structure for preventing the dryer from being separated from the stand when adjusting a height and/or an angle of the stand have not been proposed.

Further, KR 101383330 B1 discloses a structure for adjusting not only a height of a stand in which a dryer is mounted but also a rotation and an angle of the stand; however, a configuration has not been proposed in which the dryer is prevented from being separated from the stand when a posture of the stand is changed.

SUMMARY OF THE DISCLOSURE

A first problem to be solved by the present disclosure is to provide a home appliance including a dryer capable of drying an object to be dried without holding of the dryer by a user.

A second problem to be solved by the present disclosure is to provide a home appliance including a dryer in which the dryer is positioned at a predetermined position on a stand when the dryer is mounted in the stand.

A third problem to be solved by the present disclosure is to provide a home appliance including a dryer capable of preventing a dryer mounted in a stand from being unintentionally separated from the stand.

The objects of the present disclosure are not limited to the above-described objects and the other objects will be understood by those skilled in the art from the following description.

In an aspect, a home appliance includes a dryer for discharging air for drying and having a grip formed at one side to be held by a user; and a stand having a receptacle in which the grip is mounted. Therefore, a user can dry an object to be dried without holding the dryer.

The dryer and the stand each include a positioning unit disposed at each of the grip and the receptacle and for enabling the grip to position at a predetermined position (hereinafter, a correct position) on the receptacle when the grip is mounted in the receptacle.

According to an embodiment, a magnetic force acts between the positioning units of each of the dryer and the stand, the positioning units are in contact with and coupled to each other, or while a magnetic force acts between the positioning units, the positioning units are in contact with and coupled to each other and thus the grip may be positioned at a correct position. That is, a mounting position to the correct position of the grip is guided by the positioning unit, and the grip is prevented from being separated from the correct position.

For this, when the grip is positioned at the correct position, the positioning units of each of the dryer and the stand may be disposed to face each other.

Further, when a magnetic force acts between positioning units of each of the dryer and the stand, any one of the positioning units may include a magnet and the other one thereof may include a magnet and/or a magnetic substance that acts attraction with the magnet.

Further, when positioning units of each of the dryer and the stand are in contact with and coupled to each other, any one of the positioning units may include a protruding portion protruded outward and the other one thereof may include an insertion portion into which the protruding portion is inserted.

Further, while a magnetic force acts between positioning units of each of the dryer and the stand, when the positioning units are in contact with and coupled to each other, all the positioning units include opposite polarities of magnets, and any one of the positioning units may include a protruding portion protruded outward and the other one thereof may include an insertion portion into which the protruding portion is inserted.

The means for solving problems that are not described above may be sufficiently derived from a description of an embodiment of the present disclosure.

DESCRIPTION OF EXEMPLARY EMBODIMENTS

Figure 1:
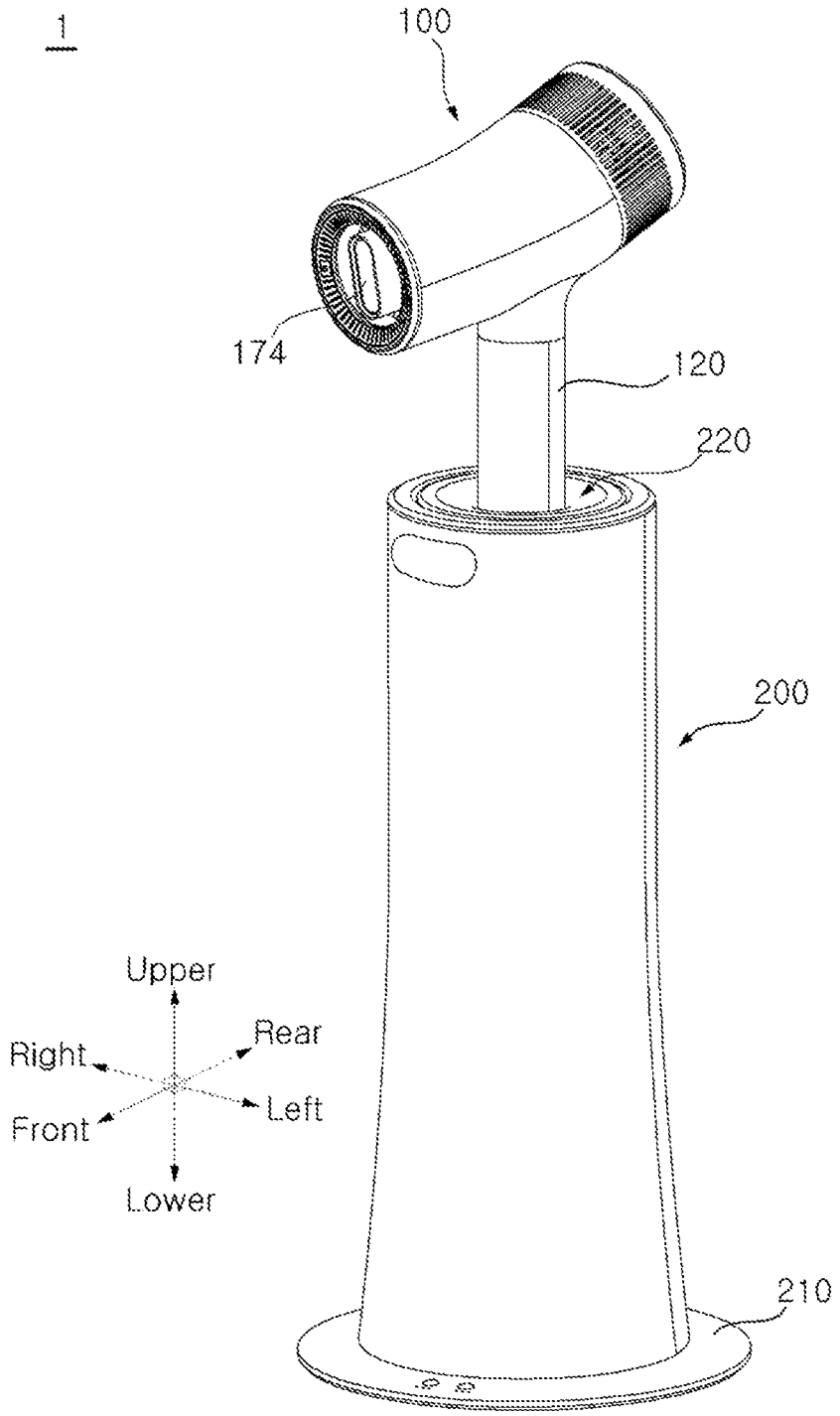
FIG. 1 is a perspective view illustrating a home appliance including a dryer according to an embodiment of the present disclosure.

The advantages and features of the present disclosure and a method of achieving them will become apparent with reference to the embodiments described in detail below together with the accompanying drawings. However, the present disclosure is not limited to the embodiments set forth herein but may be embodied in many different forms, and these embodiments are provided so that the disclosure of the present disclosure is complete and that those skilled in the art will fully understand the scope of the present disclosure, and the present disclosure is only defined by the scope of the claims. Like reference numerals designate like elements throughout the specification.

The present disclosure may be described as a three-dimensional coordinate system named as front, rear, upper, lower, left, and right, respectively, illustrated in FIG. 1.

Figure 7:
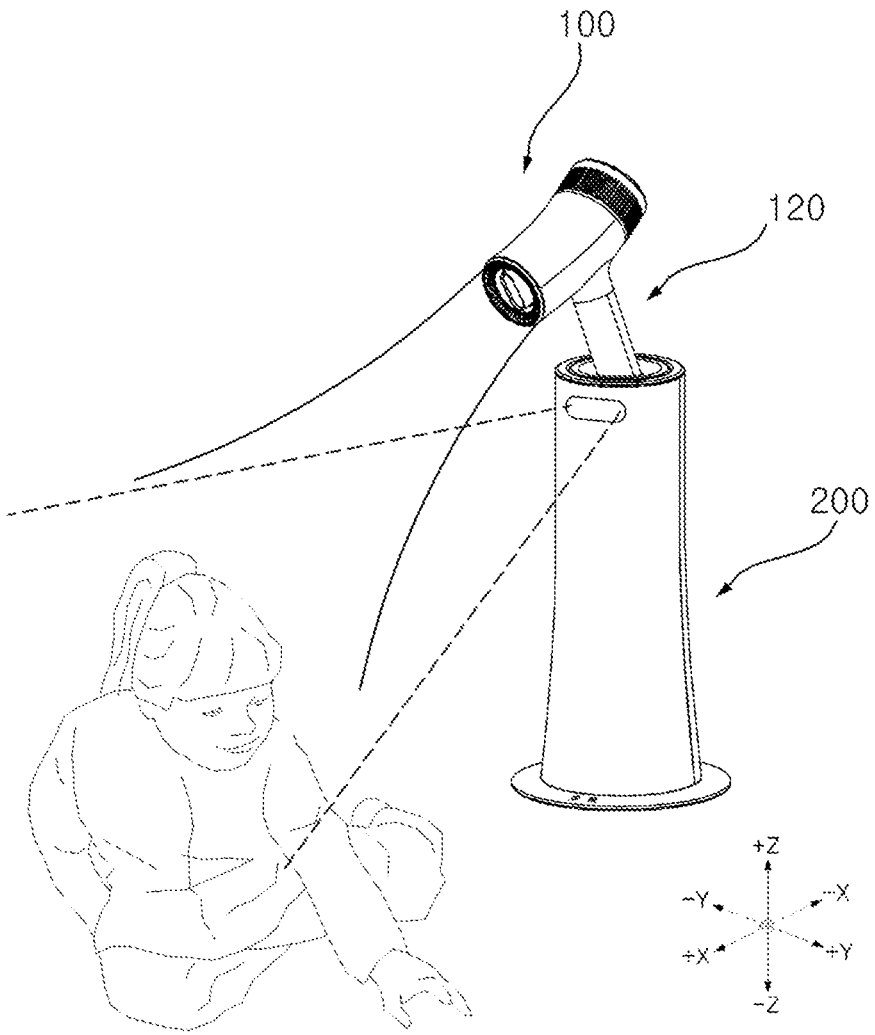
FIG. 7 is a diagram illustrating a using state of a home appliance including a dryer according to an embodiment of the present disclosure.

The present disclosure may be described on the basis of a spatial orthogonal coordinate system by X-axis, Y-axis, and Z-axis orthogonal to each other illustrated in FIG. 7 and the like. In the present specification, the X-axis, the Y-axis, and the Z-axis are defined with a vertical direction as a Z-axis direction and a front-rear direction as an X-axis direction. Each axis direction (X axis direction, Y axis direction, Z axis direction) means both directions in which each axis extends. A '+' sign (+X axis direction, +Y axis direction, +Z axis direction) in front of each axis direction means a positive direction, which is one of both directions in which each axis extends. A '−' sign (−X axis direction, −Y axis direction, −Z axis direction) in front of each axis direction means a negative direction, which is the other one of both directions in which each axis extends.

Hereinafter, a home appliance including a dryer according to an embodiment of the present disclosure will be described with reference to FIGS. 1 to 9.

Figure 2:
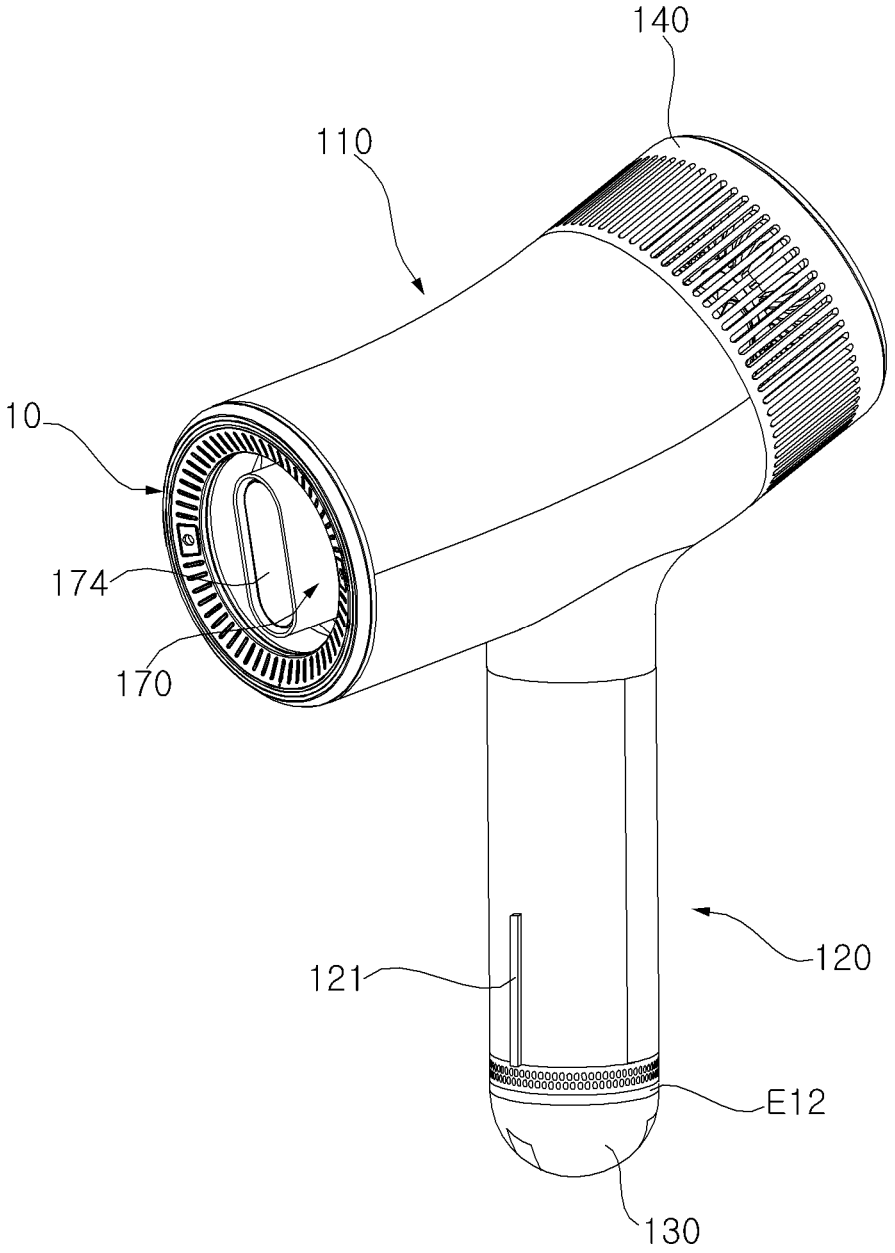
FIG. 2 is a perspective view illustrating the dryer of FIG. 1.
Figure 3:
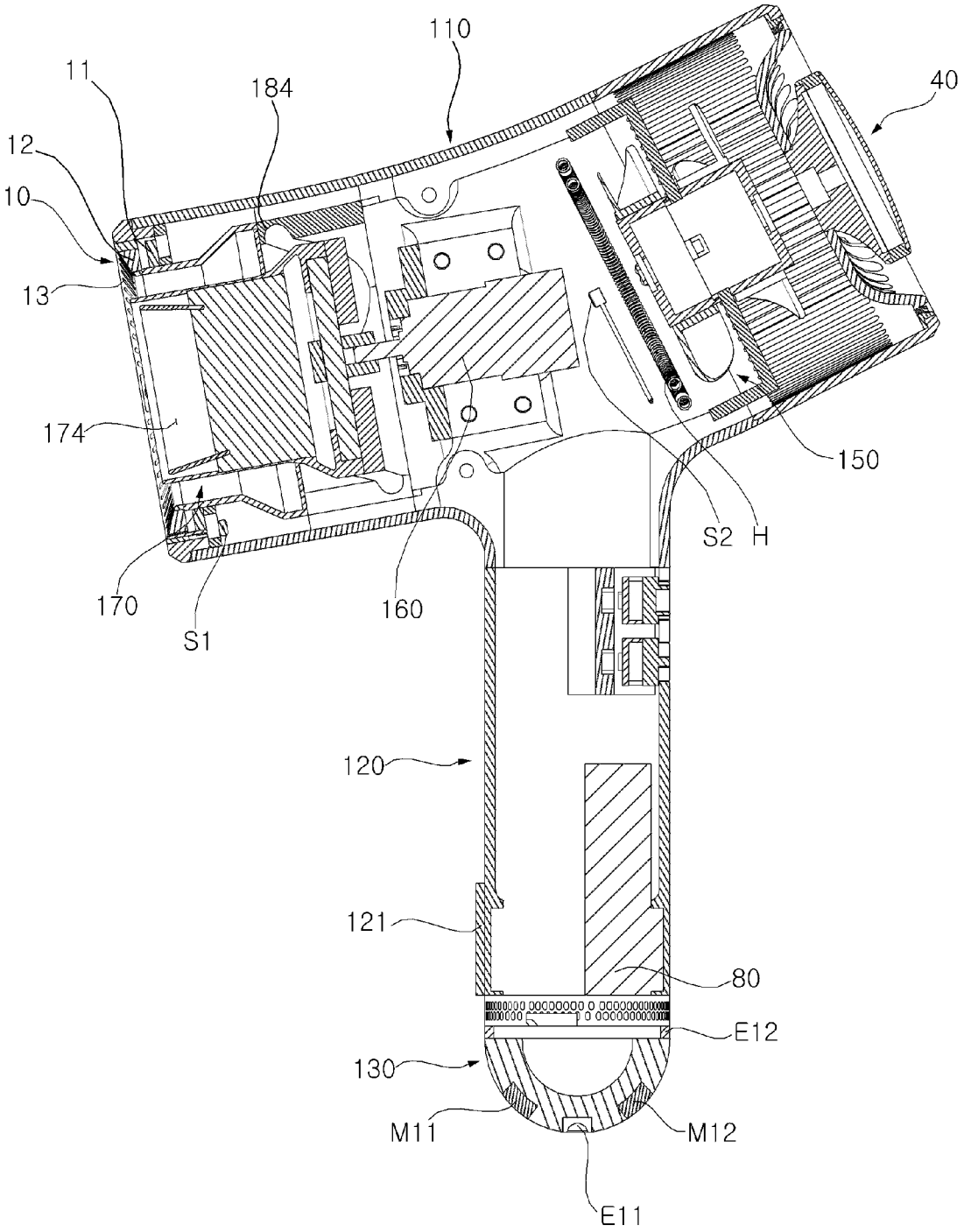
FIG. 3 is a longitudinal cross-sectional view illustrating the dryer of FIG. 1.
Figure 4A:
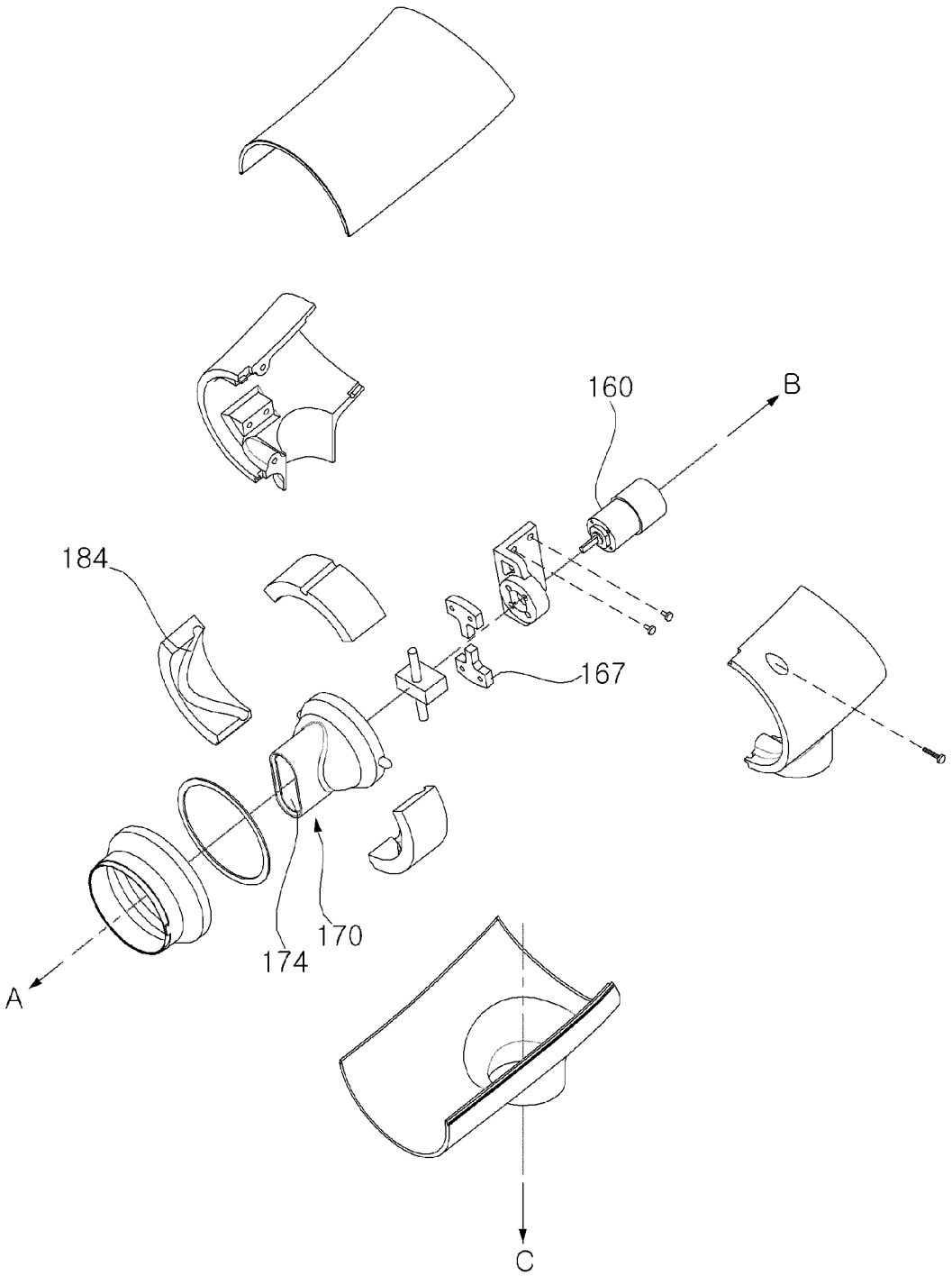
FIGS. 4A to 4D are exploded perspective views illustrating the dryer of FIG. 1.
Figure 4B:
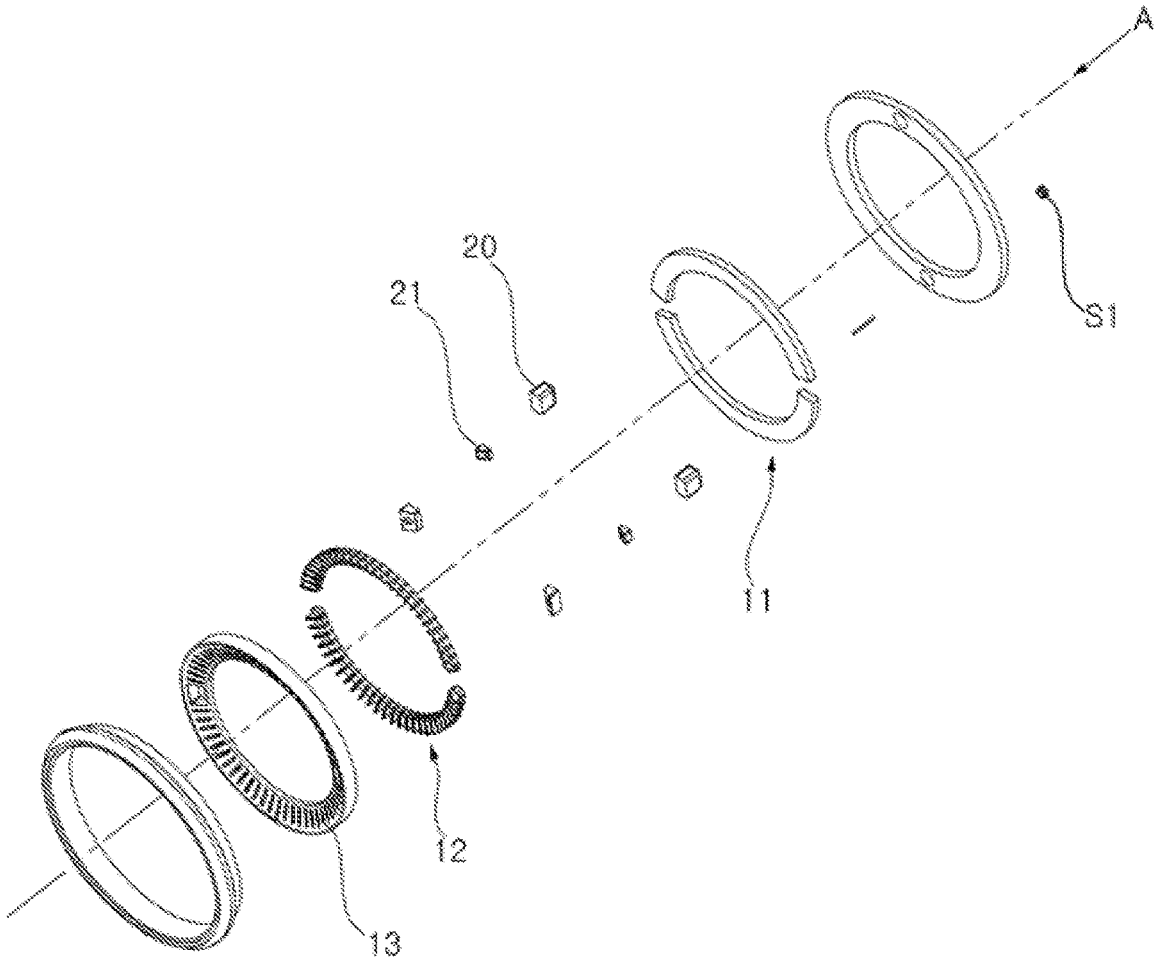
Figure 4C:
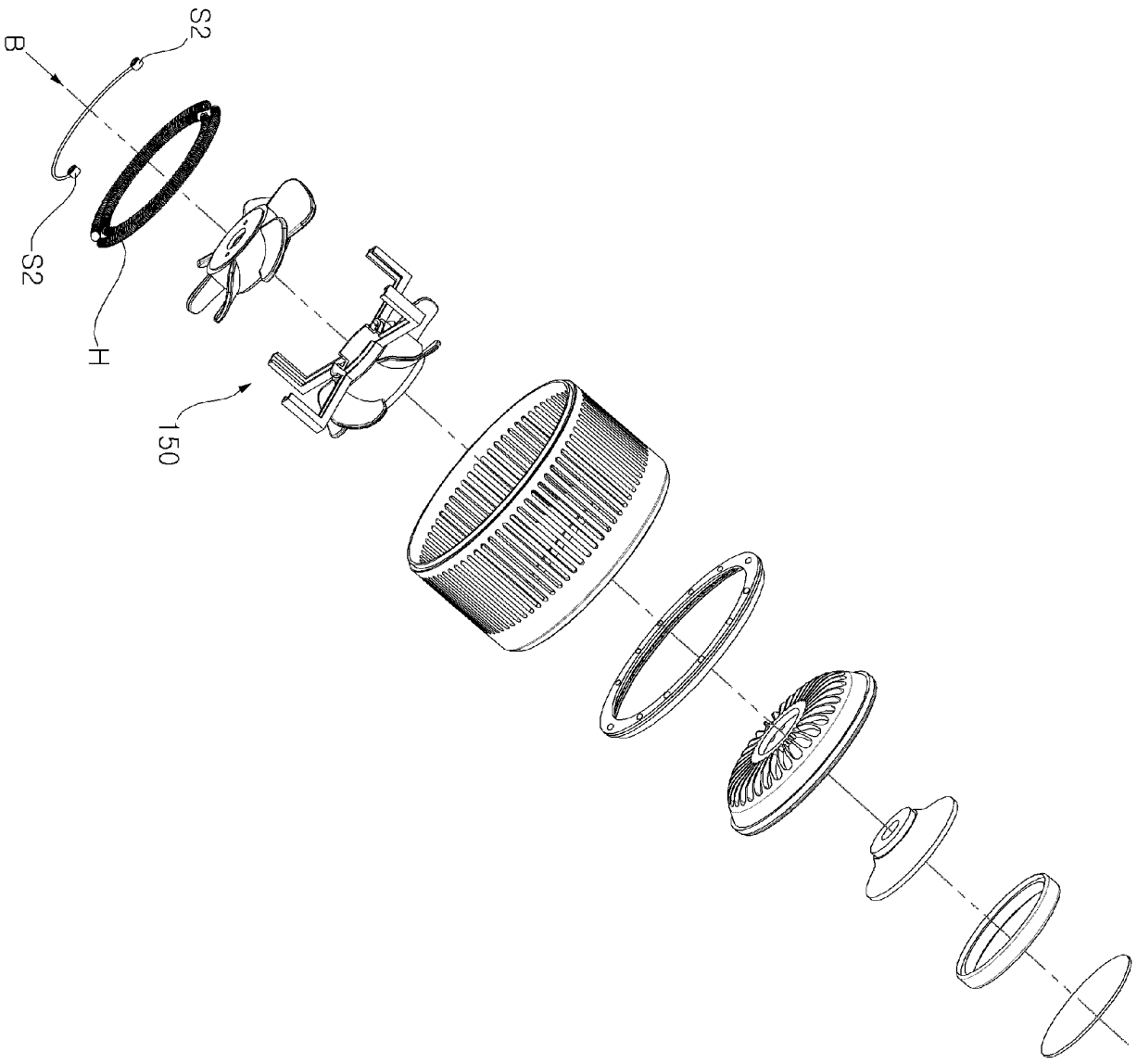
Figure 4D:
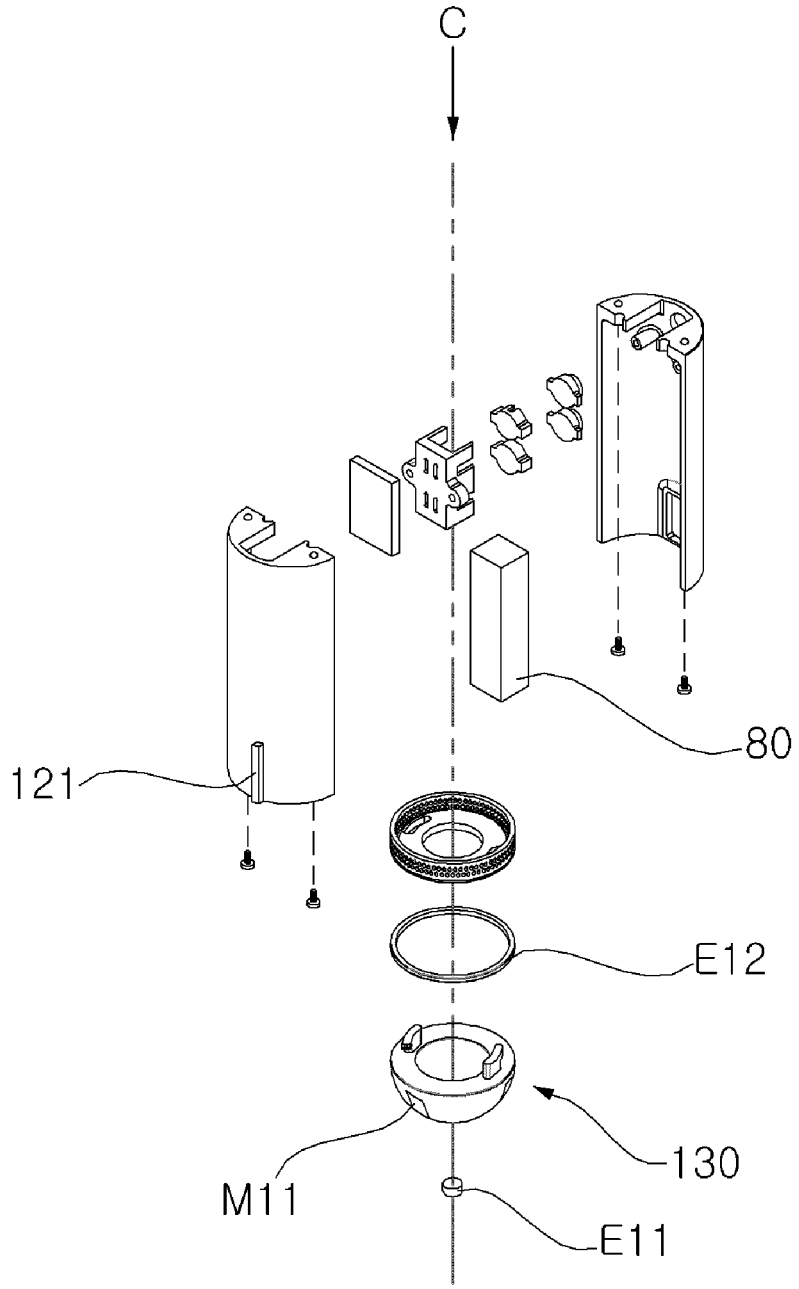
Figure 5:
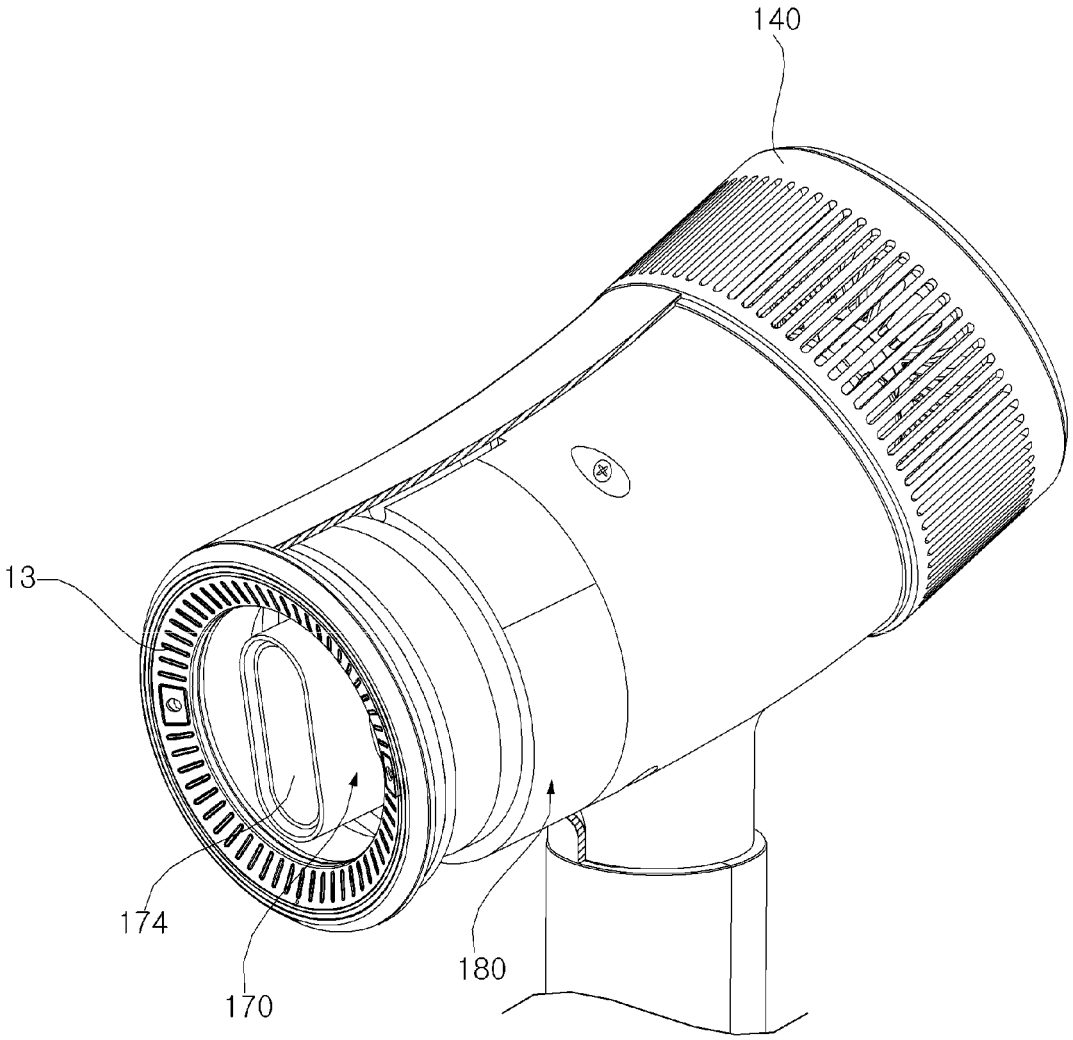
FIG. 5 is a partially cut-away perspective view illustrating a casing of the dryer of FIG. 1.
Figure 6:
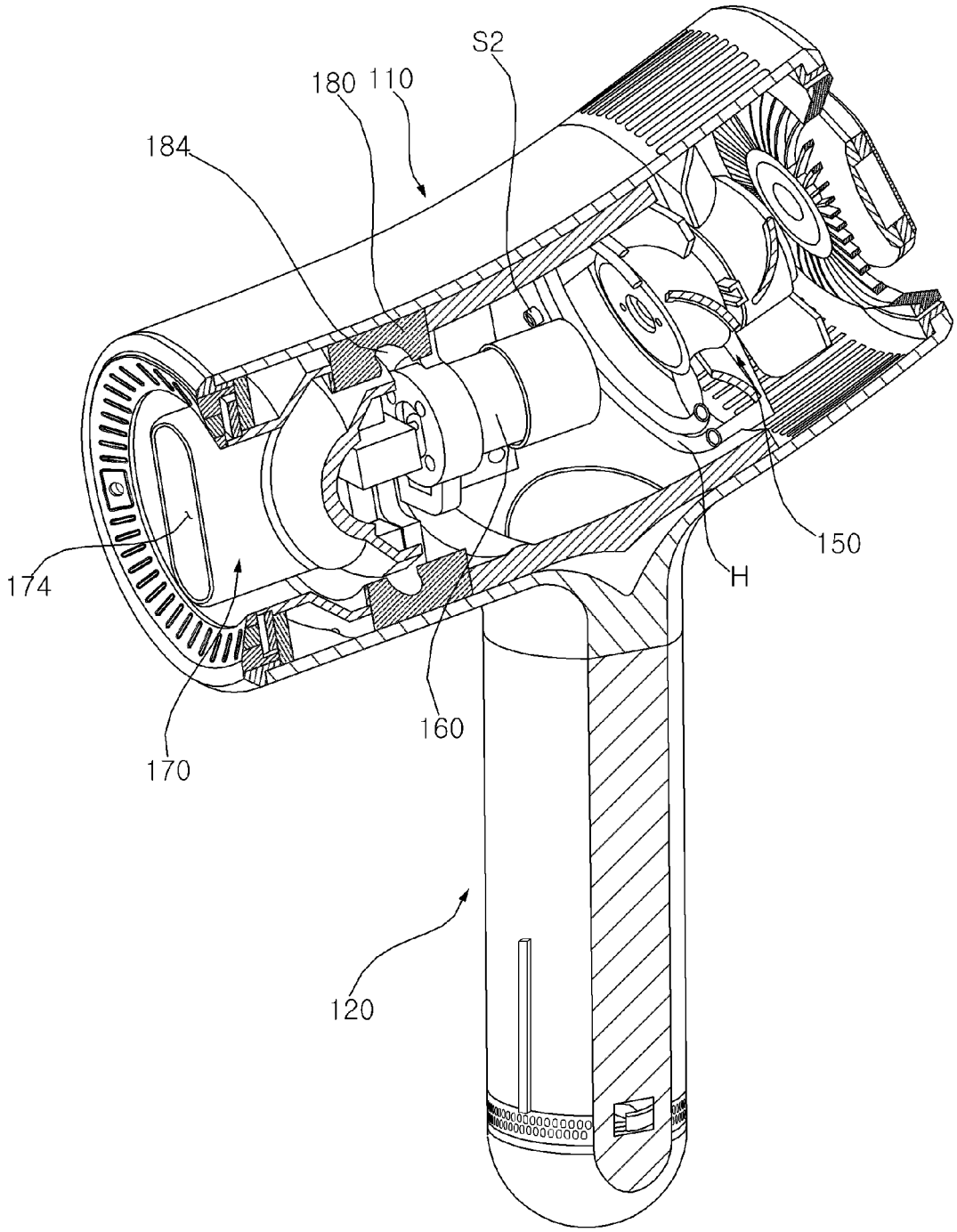
FIG. 6 is a perspective view illustrating an internal configuration of the dryer of FIG. 1.
Figure 8:
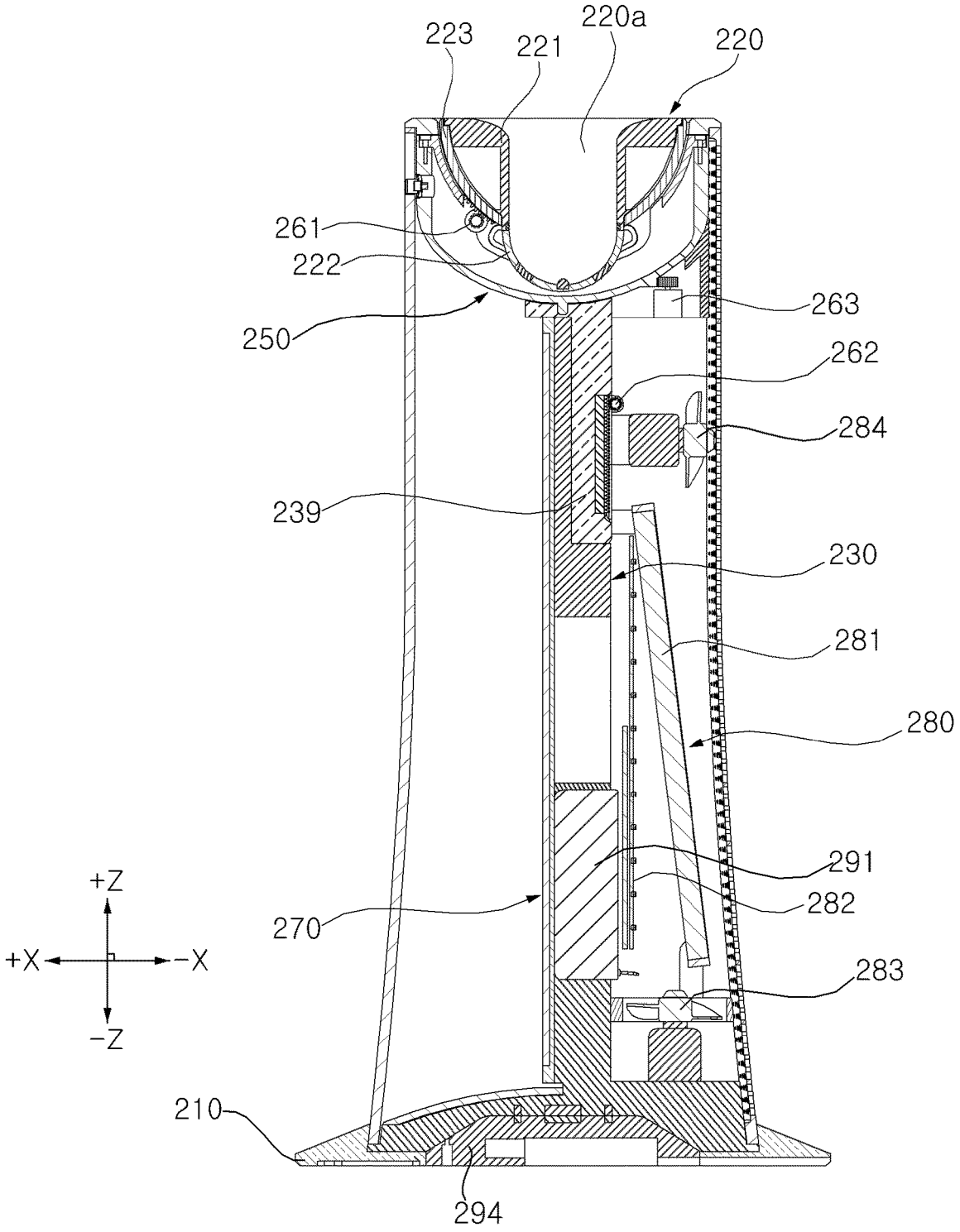
FIG. 8 is a longitudinal cross-sectional view illustrating a stand of FIG. 1.
Figure 9:
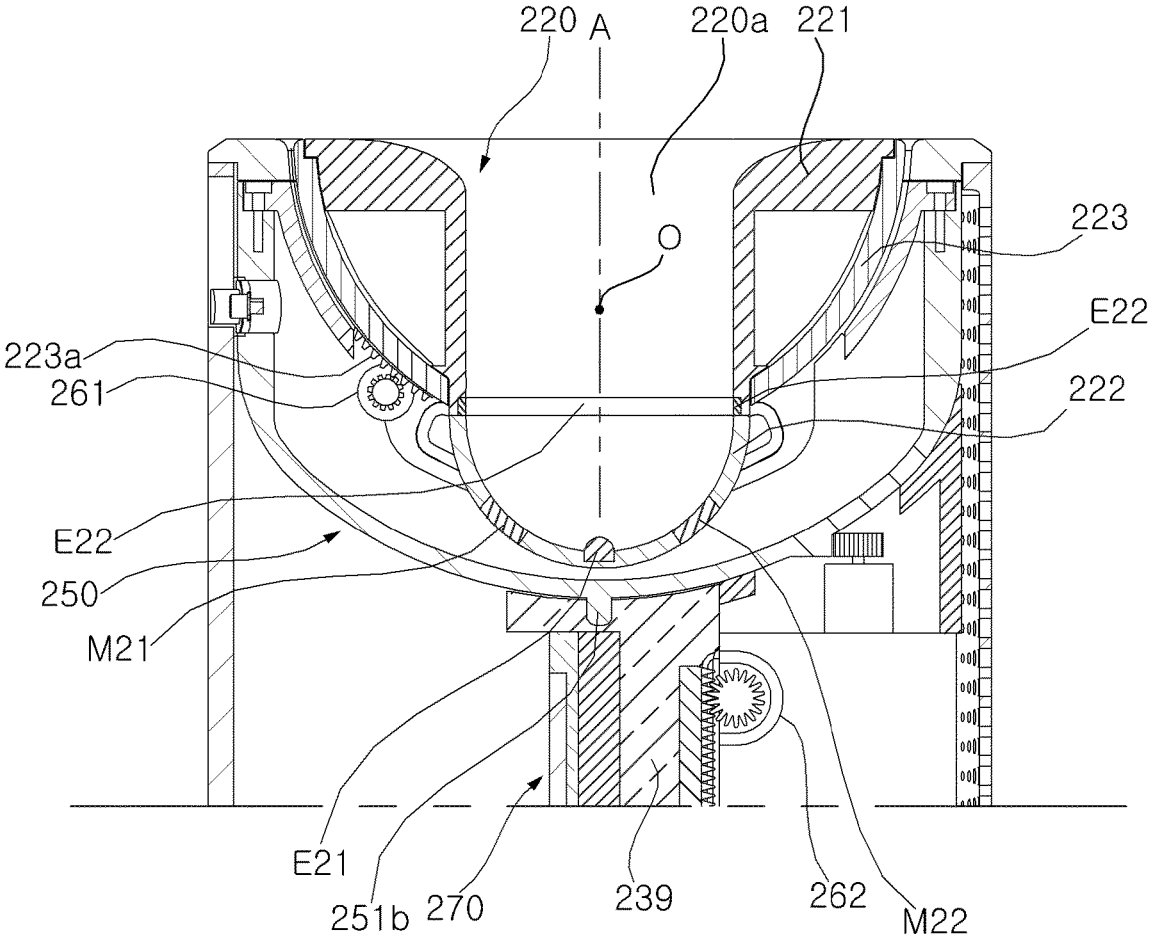
FIG. 9 is a cross-sectional view illustrating the upper side of a stand of FIG. 1.

FIG. 1 is a perspective view illustrating a home appliance including a dryer according to an embodiment of the present disclosure, FIG. 2 is a perspective view illustrating the dryer of FIG. 1, FIG. 3 is a longitudinal cross-sectional view illustrating the dryer of FIG. 1, FIGS. 4A to 4D are exploded perspective views illustrating the dryer of FIG. 1, FIG. 5 is a partially cut-away perspective view illustrating a casing of the dryer of FIG. 1, and FIG. 6 is a perspective view illustrating an internal configuration of the dryer of FIG. 1. FIG. 7 is a diagram illustrating a using state of a home appliance including a dryer according to an embodiment of the present disclosure, FIG. 8 is a longitudinal cross-sectional view illustrating the stand of FIG. 1, and FIG. 9 is a cross-sectional view illustrating the upper side of the stand of FIG. 1.

As illustrated in FIG. 1, a home appliance 1 according to an embodiment of the present disclosure includes a dryer 100 and a stand 200. The dryer 100 is a device for drying an object such as a person or a companion animal by using the drying air discharged through a discharge port 174.

As an example, which will be described, the dryer 100 has a built-in battery 80 and thus a user may carry the dryer 100 and dry the object to be dried. However, according to another arrangement, external power for replacing the battery may be applied to the dryer 100 in a wired or wireless manner, and in this arrangement, the user may also dry the object to be dried while holding the dryer 100.

The dryer 100 may be detachably mounted in the stand 200 and thus the user may dry the object to be dried without holding the dryer 100. As a result, there is an advantage that the user may dry an object to be dried without the restriction of having to hold the dryer 100.

Each of the dryer 100 and the stand 200 may perform various functions, such as care of an object to be dried or purifying the indoor air, in addition to discharge of the drying air and mounting of the dryer 100 and a configuration provided in each of the dryer 100 and the stand 200 will be simply described as follows.

As illustrated in FIGS. 2, 5 and 6, the dryer 100 includes a hollow casing 110, a fan 150 that causes a flow of air that flows into the casing 110 to be discharged to the outside, and a heater H that heats air flowing into the casing 110.

As illustrated in FIGS. 3 and 4A, the flow of air discharged to the outside of the casing 110 may be guided by a discharge tube 170. As an example, the discharge tube 170 may receive power from a motor 160 to rotate along a groove 184 formed in a cylindrical guider 180. Thereby, when the discharge tube 170 does not rotate, a concentration wind for concentrating and discharging the drying air to a predetermined drying area may be implemented, and when the discharge tube 170 rotates, a diffusion wind for diffusing and discharging the drying air to a wider area may be implemented.

As illustrated in FIGS. 3 and 4B, the dryer 100 may include a lighting device 10 that radiates light toward the front thereof and an ion generator 20 that discharges ions. As an example, as light emitted from a light emitting panel 11 provided in the lighting device 10 is radiated toward the front of the dryer 100 through a light diffusion module 12 and a light guide 13, whereby, even when drying is performed in a dark place, a state of skin or hair of an object to be dried may be easily observed. Further, ions generated in the ion generator 20 are discharged toward the front of the dryer 100 via an ion spray nozzle 21 to prevent foreign substances such as dust from being adsorbed on the object to be dried and to moisturize the skin and the hair of the object to be dried.

As illustrated in FIGS. 3 and 4C, in a rear part of the dryer 100, a display unit 40 for displaying information about the above-described functions, whether various functions implemented in the dryer 100 are operated and a temperature of an object to be dried and a temperature of the drying air detected by each of an external temperature sensor S1 and a discharge temperature sensor S2 may be disposed.

As illustrated in FIGS. 3 and 4D, grips 120 and 130 held by the user may be coupled to the lower side of the casing 110. The grips 120 and 130 may include a grip body 120 forming a peripheral surface thereof and a grip end portion 130 coupled to a lower portion of the grip body 120 to form a lower surface thereof.

As an example, the grip body 120 may be formed in a cylindrical shape, and the grip end portion 130 may be formed in a hemispherical shape. That is, an outer circumference of the grips 120 and 130 and an inner circumference of a receptacle 220 may be formed in a circular shape, and in this case, an inner circumference of the receptacle 220 in which the grips 120 and 130 to be described later are mounted may also be formed in a circular shape. Within the grips 120 and 130, a rechargeable battery 80 that supplies power to a fan 150, a heater H, the motor 160, the lighting device 10, the ion generator 20, and the display unit 40 may be disposed.

As illustrated in FIGS. 1 and 8, the stand 200 includes a stem 230 extended in a vertical direction or a Z-axis direction, a base 210 disposed at the lower side of the stem 230, a receptacle 220 disposed at the upper side of the stem 230 and in which the grips 120 and 130 of the dryer are detachably mounted, and a cover 240 for forming a side surface of the stand 200.

As illustrated in FIG. 8, air in an indoor space where the stand 200 is positioned may flow into the interior of the stand 200 by fans 283 and 284 and be purified by passing through an air purifier 280. As an example, the air purifier 280 may include a photocatalytic filter 281 disposed at a rear surface of the stem 230 and is capable of removing an odor of a companion animal or a human by a principle of decomposing harmful substances by a photochemical reaction and a light emitting module 282 for activating a photocatalyst.

As illustrated in FIG. 8, the dryer may include a light care device 270 for radiating light toward the front of the stand 200. As an example, the light care device 270 is disposed at the front side of the stem 230 and radiates light having a spectrum similar to natural light from an organic light emitting diode (OLED) panel to help alleviate depression symptoms of users and companion animals due to lack of going outside.

As illustrated in FIGS. 8 and 9, the receptacle 220 is provided to vertically move, rotate in a left-right direction, and/or rotate in a front-rear direction to convert a drying air discharge direction of the dryer 100 mounted in the receptacle 220 to a vertical direction, a left-right direction, and/or a front-rear direction. As an example, the receptacle 220 may receive power from an elevating motor 262 through a supporter 250 coupled thereto and a vertical rod 239 connected to the supporter 250 to be moved in a vertical direction. Further, the receptacle 220 may receive power from a rotation motor 263 through the supporter 250 to rotate in a left-right direction about a groove formed in the vertical rod 239 and a projection 251*b* inserted into the groove. Further, the receptacle 220 may receive power from a tilting motor 261 through tilting gear teeth 223*a* formed at one side to rotate (i.e., tilt) in a front-rear direction.

As illustrated in FIG. 8, in the stem 230, a rechargeable battery 291 for supplying power to the fans 283 and 284, the air purifier 280, the light care device 270, the elevation motor 262, the rotation motor 263, and the tilting motor 261 may be disposed. In this case, as external power is applied through a docking station 294 coupled to the base 210, the battery 291 may be charged.

As illustrated in FIGS. 4D and 9, a pair of electrode terminals E11 and E12 may be disposed at the grips 120 and 130 and a pair of electrode terminals E21 and E22 may be disposed at the receptacle 220 to correspond thereto. When the grips 120 and 130 are mounted in the receptacle 220, external power may be applied to the battery 80 of the dryer through the electrode terminal to charge the battery 80. Electrode terminals E11 and E21 may be point terminals and electrode terminals E21 and E22 may be annular terminals. Thus, even if the grips 120 and 130 are rotated in the receptacle 220, charging may be continuously performed.

In the foregoing description, a structure and function of the dryer 100 and the stand 200 provided in the home appliance 1 according to an embodiment of the present disclosure has been simply described. However, as described above, as the receptacle 220 moves in a vertical direction, rotates in a lateral direction and/or rotates in a front-rear direction (hereinafter, a movement of the receptacle 220 may be collectively referred to as a posture change of the receptacle 220), the grips 120 and 130 of the dryer mounted in the receptacle 220 may be separated from the receptacle 220.

Therefore, when the grips 120 and 130 of the dryer are mounted in the receptacle 220, by enabling the grips 120 and 130 to be fixed at a predetermined position, the present disclosure has been devised to prevent the dryer 100 from being damaged or from creating a safety hazard such as a fire because of unintentional separation of the dryer 100 from the stand 200 during a posture (position) change of the receptacle 220.

Hereinafter, in a configuration of a home appliance according to the embodiment of the present disclosure, a configuration that enables the grips 120 and 130 to be positioned or fixed at predetermined positions on the receptacle 220 and a configuration related thereto will be described in detail with reference to FIGS. 1 to 12.

Figure 10A:
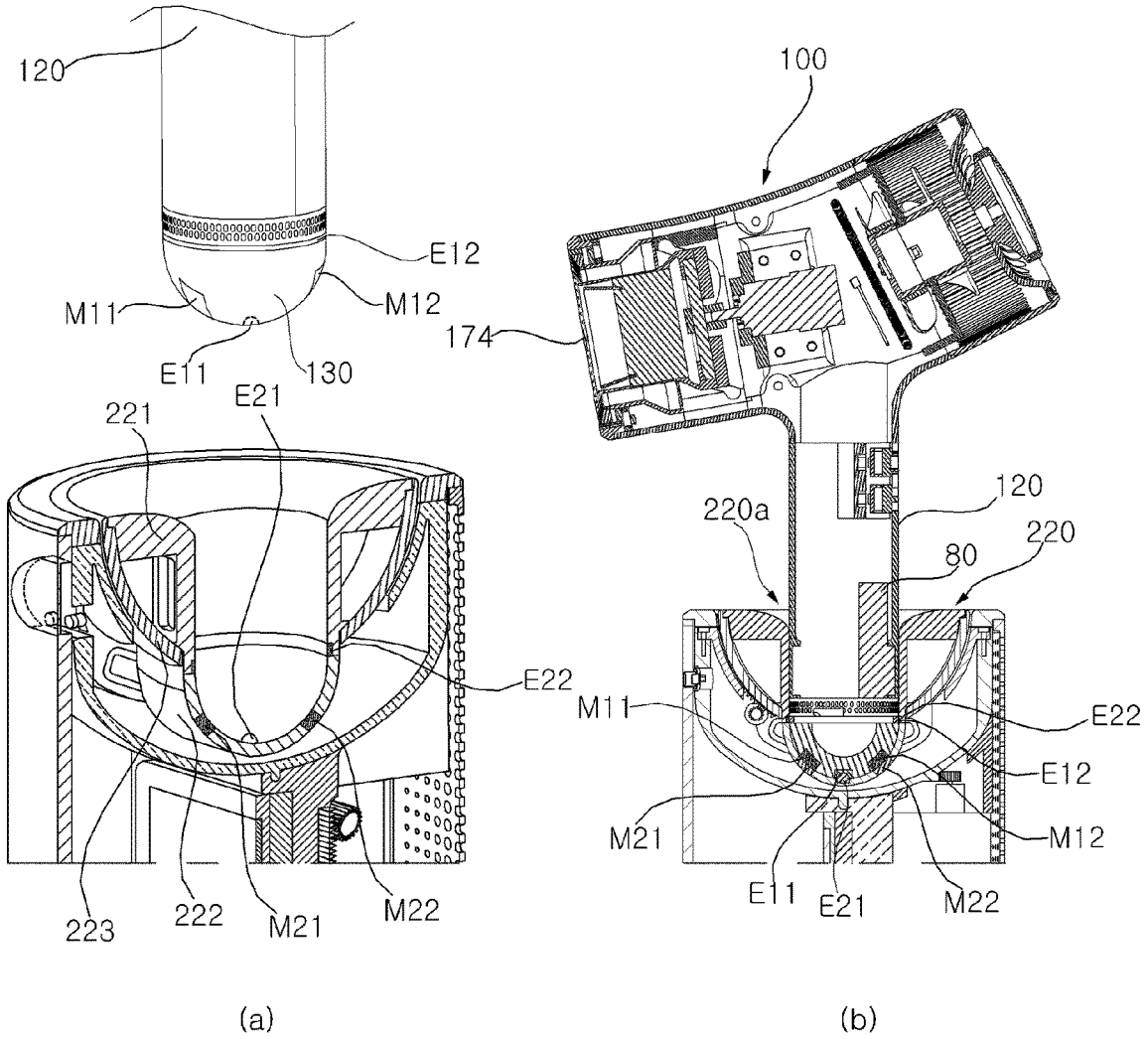
FIGS. 10A to 10E are diagrams illustrating a shape in which a dryer is mounted in a stand according to an embodiment of the present disclosure.
Figure 10B:
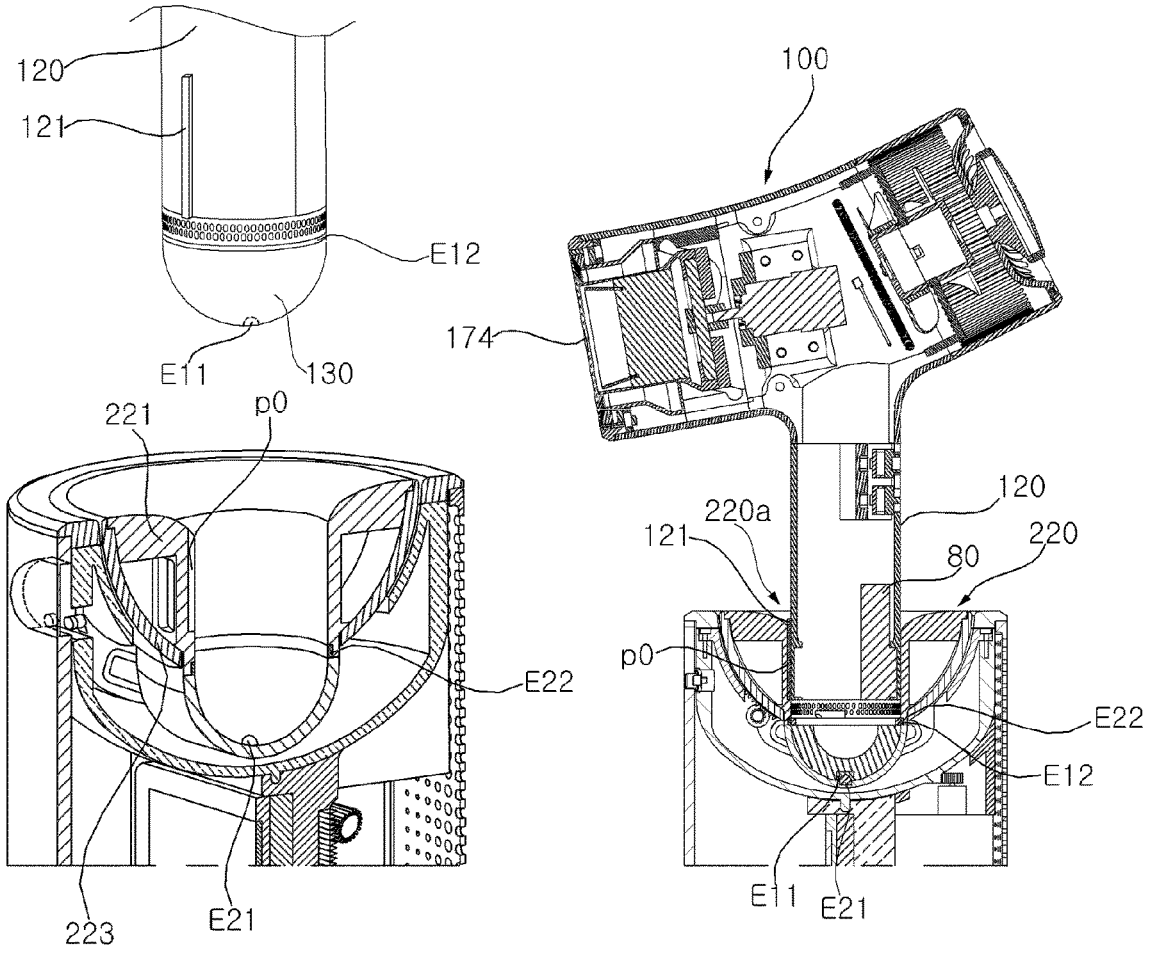
Figure 10C:
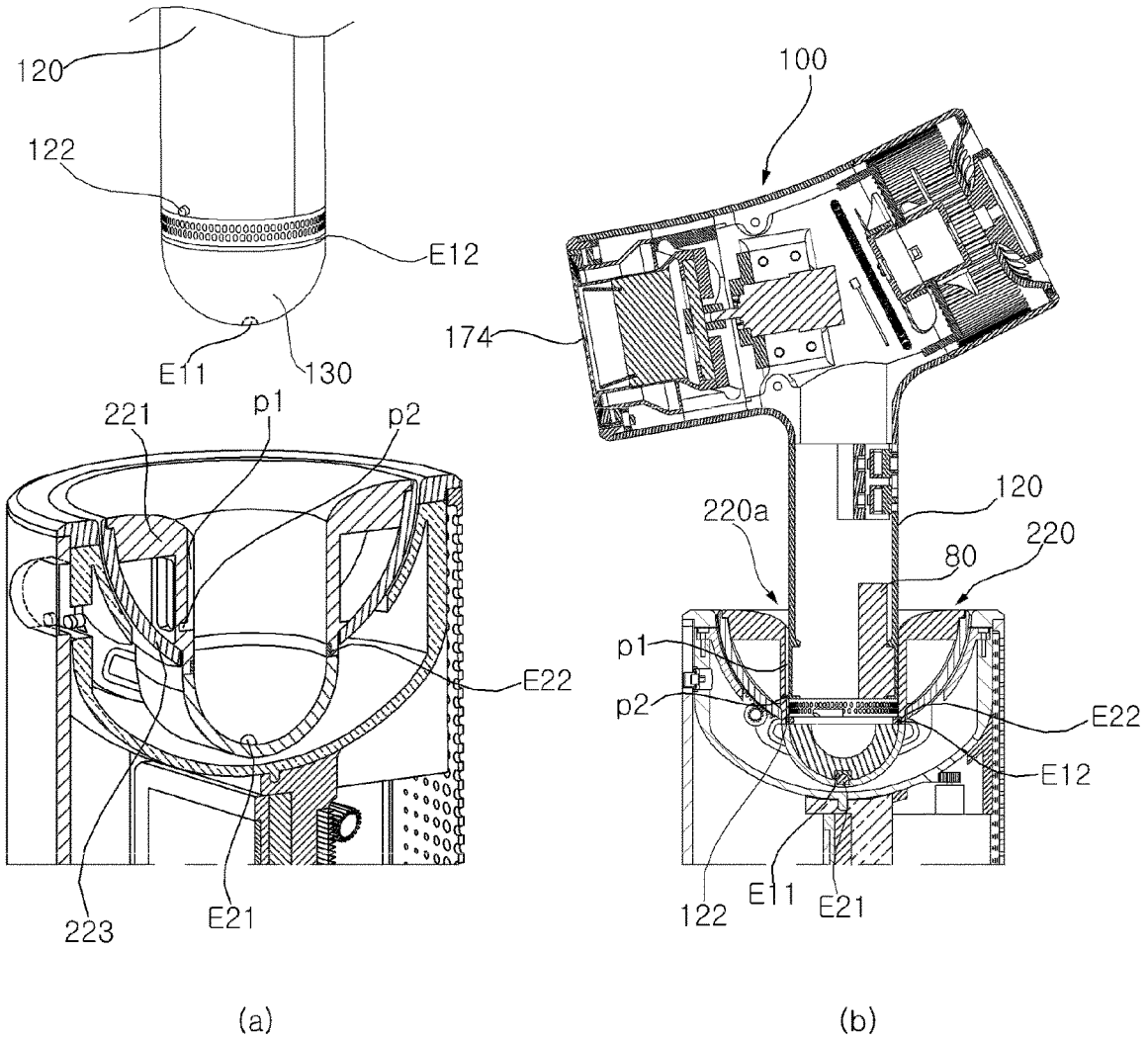
Figure 10D:
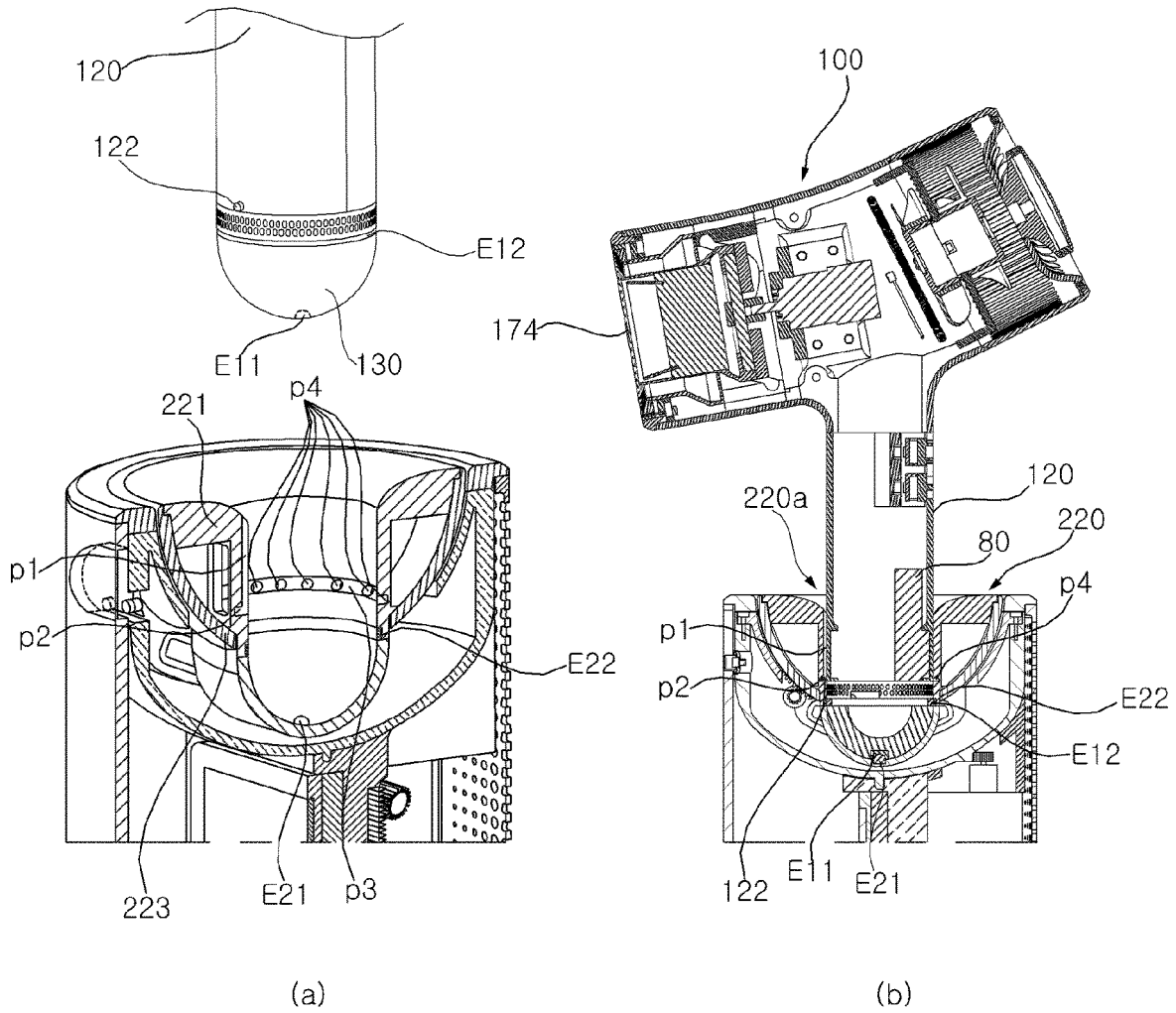
Figure 10E:
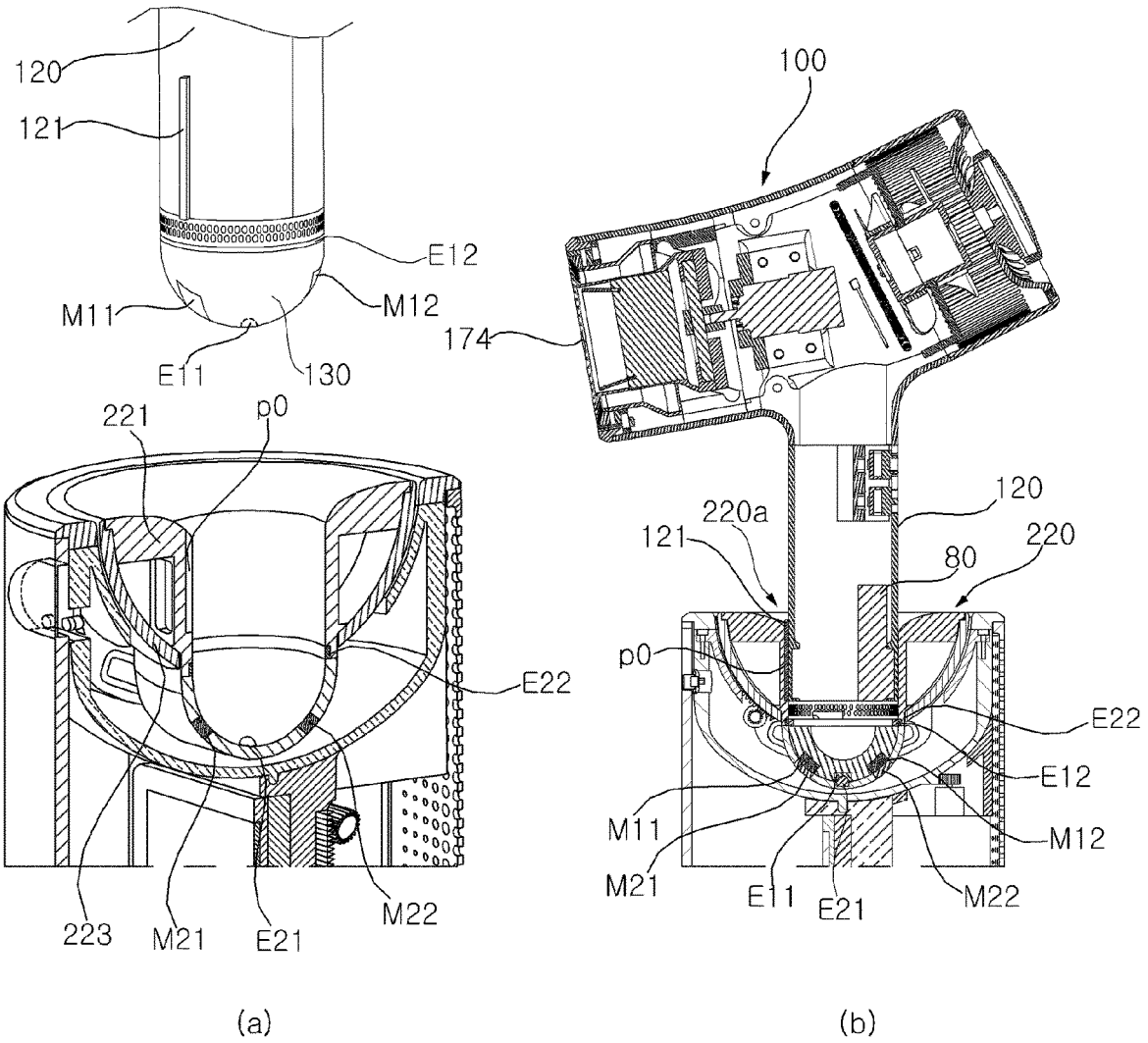
Figure 11:
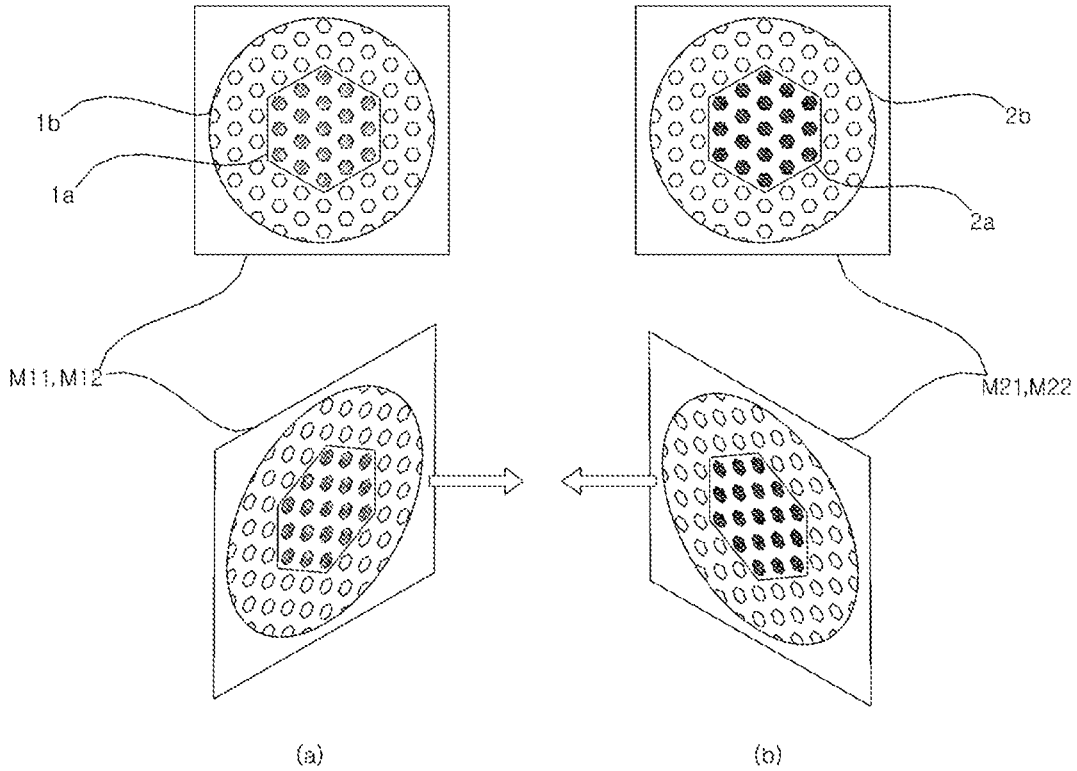
FIG. 11 is a diagram illustrating a shape that adjusts a polarity of each of a plurality of magnetic pixels provided in a positioning unit according to an embodiment of the present disclosure.
Figure 12:
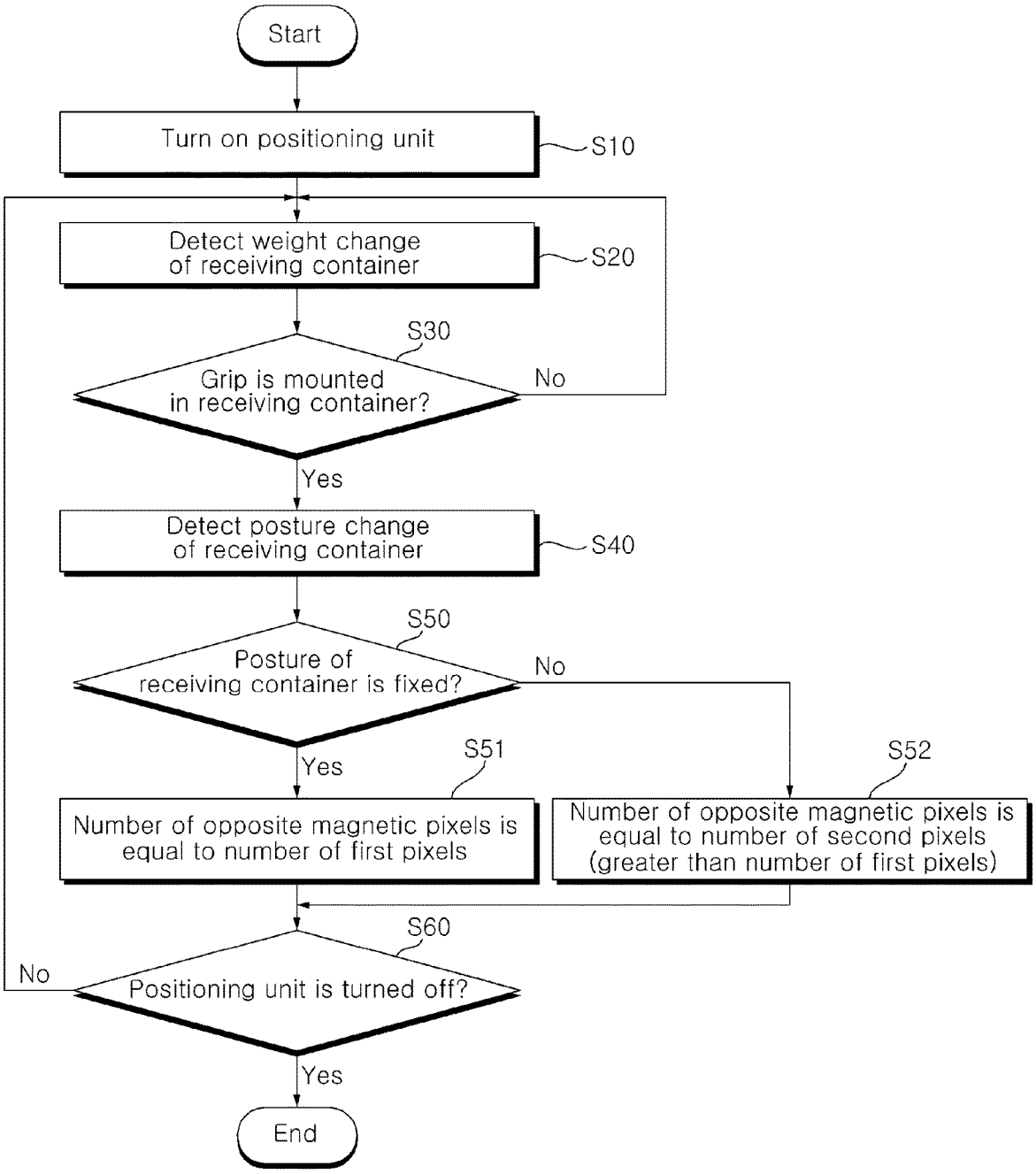
FIG. 12 is a flowchart illustrating a method of adjusting a coupling force between a dryer and a stand by adjusting a polarity of each of a plurality of magnetic pixels provided in a positioning unit according to an embodiment of the present disclosure.

FIGS. 10A to 10E are diagrams illustrating a shape in which a dryer is mounted in a stand according to an embodiment of the present disclosure, FIG. 11 is a diagram illustrating a shape that adjusts a polarity of each of a plurality of magnetic pixels provided in a positioning unit according to an embodiment of the present disclosure, and FIG. 12 is a flowchart illustrating a method of adjusting a coupling force between a dryer and a stand by adjusting a polarity of each of a plurality of magnetic pixels provided in a positioning unit according to an embodiment of the present disclosure.

In the home appliance 1 according to the embodiment of the present disclosure configured in foregoing description and in the following description, each of the dryer 100 and the stand 200 includes a positioning unit (positioner) disposed in each of the grips 120 and 130 and the receptacle 220.

The positioning unit enables the grips 120 and 130 to be positioned at a predetermined position (hereinafter, a correct position) on the receptacle 220. Here, positioning of the grips 120 and 130 at a correct position may mean not only guiding the grips 120 and 130 to the correct position, but also fixing of the grips 120 and 130 at a correct position.

According to an embodiment, a magnetic force acts between the positioning units, the positioning units are in contact with and coupled to each other, or the positioning units are in contact with and coupled to each other with a magnetic force acting therebetween and thus the grips 120 and 130 may be positioned at a correct position, and each embodiment will be described in detail as follows. In this case, in the following description of each embodiment, a description of the same configuration as the previously described configuration will be omitted.

As illustrated in FIG. 10A, when the grips 120 and 130 are mounted in the receptacle 220, a magnetic force acts between the positioning units of each of the dryer 100 and the stand 200 according to this embodiment of the present disclosure and thus the grips 120 and 130 may be positioned at the correct position.

Positioning units (hereinafter, first positioning units or first positioners) PU1 (M11, M12) of the dryer 100 may be disposed at one side of the grips 120 and 130. FIG. 10A illustrates that the first positioning unit PU1 is disposed at one side of the grip end portion 130, but it is not limited thereto and the first positioning unit PU1 may be disposed at one side of the grip body 120.

The first positioning unit PU1 may include a plurality of first positioning units spaced apart from each other by a predetermined distance. As an example, as illustrated in FIG. 10A, the dryer 100 may include two first positioning units M11 and M12 spaced apart by an angle of 180°.

Positioning units (hereinafter, second positioning units or second positioners) PU2 (M21, M22) of the stand 200 may be disposed at one side of the receptacle 220 to face the first positioning unit PU1 when the grips 120 and 130 are positioned to a correct position.

As illustrated in FIGS. 8, 9 and 10A, the receptacle 220 may include upper and lower tubs 221 and 222 forming a groove 220*a* into which the grips 120 and 130 are inserted. Further, the receptacle 220 may include a tub cover 223 that covers the outer side of the upper tub 221. In this case, when the grips 120 and 130 are mounted in the receptacle 220, an inner surface of the upper tub 221 may be in close contact with an outer side surface of the grip body 120, and an inner surface of the lower tub 222 may be in close contact with an outer side surface of the grip end portion 130.

FIG. 10A illustrates that the second positioning unit PU2 is disposed at one side of the lower tub 222 of the receptacle 220, but it is not limited thereto and the second positioning unit PU2 may be disposed at one side of the upper tub 221.

The second positioning unit PU2 may be a plurality of second positioning units spaced apart from each other by a predetermined distance. As one example, as illustrated in FIG. 10A, the stand 200 may include two positioning units M21 and M22 spaced apart by an angle of 180°.

As described above, when a plurality of first positioning units M11 and M12 and a plurality of second positioning units M21 and M22 are provided, a coupling force between the grips 120 and 130 and the receptacle 220 can be increase and coupling stability thereof can be improved, compared with an arrangement where the first positioning units M11 and M12 and the second positioning units M21 and M22 are provided as single units.

A magnetic force may act between the first positioning units M11 and M12 and the second positioning units M21 and M22. For this reason, one of the first positioning units M11 and M12 and the second positioning units M21 and M22 includes a magnet, and the other one thereof may include a magnetic substance that acts attraction with the magnet. Alternatively, according to the embodiment, each of the first positioning units M11 and M12 and the second positioning units M21 and M22 may include magnets of mutually opposite polarities.

That is, as a force acting between the magnet-magnetic substance or the magnet-magnet, using a principle in which attraction acts between different kinds of poles (N pole-S pole) and in which repulsion acts between the same kinds of poles (N pole-N pole, S pole-S pole), the grips 120 and 130 may be positioned and fixed at the correct position.

As an example, as illustrated in FIG. 10A, when the grips 120 and 130 are mounted in the receptacle 220, first positioning unit M11 among the first positioning units M11 and M12 have different types of magnetic poles from that of second position unit M21 are formed based on a surface facing the second positioning units M21 and M22 and thus attraction may act on each other, and the same kind of magnetic pole from that of second positioning unit M22 is formed and thus repulsion may act on each other.

Further, as illustrated in FIG. 10A, when the grips 120 and 130 are mounted in the receptacle 220, first positioning unit M12 among the first positioning units M11 and M12, different types of magnetic poles from that of second positioning unit M22 are formed based on a surface facing the second positioning units M21 and M22 and thus attraction acts on each other, and the same kind of magnetic poles as that of second positioning unit M21 are formed and thus repulsion may act on each other.

As a result, when the grips 120 and 130 are mounted in the receptacle 220, first positioning unit M11 may move away from second positioning unit M22 and approaches second positioning unit M21, and first positioning unit M12 may move away from second positioning unit M21 and approaches second positioning unit M22 according to the above-mentioned magnetic force (attraction or repulsion). That is, the correct position may be understood as a position in first and second positioning units M11 and M12 face first and second positioning units M21 and M22, respectively, and, in this arrangement, a discharge direction of the drying air from the discharge port 174 of the dryer may be directed forward or toward an +X axis direction.

Therefore, the grips 120 and 130 may be guided to be positioned at the correct position regardless of a direction in which the user mounts the grips 120 and 130 in the receptacle 220, and the grips 120 and 130 may be fixed while being positioned at the correct position.

In the foregoing description, two first positioning units M11 and M12 and two second positioning units M21 and M22 are provided; however, each of the first positioning units M11 and M12 and the second positioning units M21 and M22 may be provided singly or as three or more.

As described above, outer peripheries of the grips 120 and 130 may be formed in a circular shape in consideration of a gripping feeling of the user, and an inner circumference of the receptacle 220 may also be formed in a circular shape to correspond to a shape of the grips 120 and 130. In this case, guide or a movement of the grips 120 and 130 to the predetermined position by the positioning unit may be smoothly performed. However, a shape of the grips 120 and 130 and the receptacle 220 of the present disclosure is not limited thereto.

As illustrated in FIG. 10B, when the grips 120 and 130 are mounted in the receptacle 220, positioning units of each of the dryer 100 and the stand 200 according to this embodiment of the present disclosure are in contact with and coupled to each other and thus the grips 120 and 130 may be positioned at a correct position.

A positioning unit (hereinafter, a first positioning unit or first positioner) PU1', 121 of the dryer 100 may be disposed at one side of the grips 120 and 130. FIG. 10B illustrates that the first positioning unit PU1' is disposed at one side of the grip body 120, but it is not limited thereto and the first positioning unit PU1' may be disposed at one side of the grip end portion 130.

FIG. 10B illustrates that the first positioning unit PU1' is provided as a single unit; however, the first positioning unit PU1' may include a plurality of first positioning units spaced apart from each other by a predetermined distance according to an embodiment.

When the grips 120 and 130 are positioned at the normal position, the positioning unit PU2', p0 (hereinafter, a second positioning unit or second positioner) of the stand 200 may be disposed at one side of the receptacle 220 to be in contact with the first positioning unit PU1'.

FIG. 10B illustrates that the second positioning unit PU2' is formed at one side of the upper tub 221 of the receptacle 220; however, it is not limited thereto and the second positioning unit PU2' may be disposed at one side of the lower tub 222.

FIG. 10B illustrates that the second positioning unit PU2' is provided with a single unit; however, the second positioning unit PU2' may be a plurality of second positioning units spaced apart from each other by a predetermined distance according to an embodiment.

As described above, when the first positioning unit PU1' and the second positioning unit PU2' are each provided as single units, repair and management may be facilitated when compared with an arrangement where a plurality of first positioning units PU1' and second positioning units PU2' are provided.

The first positioning unit PU1' and the second positioning unit PU2' may be in contact with and coupled to each other. For this reason, any one of the first positioning unit PU1' and the second positioning unit PU2' may include a protruding portion protruded outward, and the other one thereof may include an insertion portion into which the protruding portion is inserted. As an example, as illustrated in FIG. 10B, the first positioning unit PU1' may include a protruding portion, and the second positioning unit PU2' may include an insertion portion.

In this case, the protruding portion may include a protruding rib 121 extended in a direction (i.e., −Z-axis direction) (hereinafter, a first direction) in which the grips 120 and 130 are mounted in a receptacle 220. Further, the insertion portion may include an insertion groove p0 extended in the first direction and into which at least a portion of the protruding rib 121 is inserted. In this case, FIG. 10B illustrates that the insertion groove p0 is recessed at one side of the upper tub 221, the insertion groove may be formed between two ribs protruded from one side of the upper tub 221 according to an embodiment.

The grips 120 and 130 may be mounted in the receptacle 220 only in a direction in which the protruding rib 121 is inserted into the insertion groove p0. That is, the correct position may be understood as a position where the protruding rib 121 is in contact with and coupled to the insertion groove p0, and in this case, a discharge direction of the drying air from the discharge port 174 of the dryer may be directed forward or toward +X axis direction.

Thereby, the user may guide the grips 120 and 130 to be positioned at the correct position, and the grips 120 and 130 may be fixed with positioned at the correct position.

The protruding portion and the insertion portion may be formed in a direction deviated from a discharging direction of the drying air of the dryer. That is, when the protruding portion and the insertion portion are formed at positions shifted to the right side of the front of the grips 120 and 130, if the user holds the grips 120 and 130 with a right hand, a position of the protruding portion and the insertion portion may be easily checked.

As illustrated in FIG. 10C, positioning units of each of the dryer 100 and the stand 200 according to this embodiment of the present disclosure are in contact with and coupled to each other similar to the preceding embodiment and thus the grips 120 and 130 may be positioned at the correct position.

That is, a positioning unit (hereinafter, a first positioning unit or first positioner) PU1", 122 of the dryer 100 and a positioning unit (hereinafter, a second positioning unit or second positioner) PU2", p1 and p2 of the stand 200 may be in contact with and coupled to each other. For this reason, any one of the first positioning unit PU1" and the second positioning unit PU2" may include a protruding portion protruded outward, and the other one thereof may include an insertion portion into which the protruding portion is inserted. As an example, as illustrated in FIG. 10C, the first positioning unit PU1" may include the protruding portion and the second positioning unit PU2" may include the insertion portion.

However, unlike the preceding embodiment, the protruding portion according to this embodiment of the present disclosure may include a projection 122 of an elastic material. Therefore, when a predetermined force is applied to the projection 122, a length and/or a shape of the projection 122 may be changed, and when a predetermined force is not applied to the projection 122, the projection 122 may be restored to an original length and/or original shape thereof.

As an example, the projection 122 may be made of a rubber material and vary in volume depending on an applied pressure and include a spring according to an embodiment, and a level protruded from the grips 120 and 130 may be adjusted according to an applied pressure.

The insertion portion may include a vertical guide path p1 and a first seating groove p2.

As illustrated in FIG. 10C, the vertical guide path p1 may be extended in a direction (i.e., −Z axis direction) (hereinafter, a first direction) in which the grips 120 and 130 are mounted in the receptacle 220.

In this arrangement, the vertical guide path p1 may be recessed at one side of the upper tub 221 and be recessed by a length smaller than a level in which the projection 122 is protruded from an outer side surface of the grip body 120. As a result, when the grips 120 and 130 are mounted in the receptacle 220, the vertical guide path p1 may apply a pressure to the projection 122 in a rearward direction or an −X axis direction so that the projection 122 is compressed with a predetermined ratio or more. Further, the vertical guide path p1 may guide a sliding movement of the projection 122 in a first direction.

Therefore, in order to mount the grip 120 in the receptacle 220, it is necessary for the user to apply a predetermined force and to insert the projection 122 into the vertical guide path p1. In other words, the grips 120 and 130 may be mounted in the receptacle 220 only in a direction in which the projection 122 is inserted into the vertical guide path p1. That is, the correct position may be understood as a position where the projection 122 is in contact with and coupled to the vertical guide path p1, and in this case, a discharge direction of the drying air from the discharge port 174 of the dryer may be directed forward or in an +X axis direction.

As illustrated in FIG. 10C, the first seating groove p2 may be connected to a lower portion of the vertical guide path p1 or one end in the −Z axis direction. In this arrangement, the first seating groove p2 may be recessed at one side of the upper tub 221 and be recessed by a length greater than a level in which the vertical guide path p1 is recessed. As a result, the first seating groove p2 may release at least some of a pressure applied to the projection 122 by the vertical guide path p1. Further, the projection 122 may be seated in the first seating groove p2, and when the projection 122 is seated in the first seating groove p2, the user may detect the seating in the first seating groove p2.

Accordingly, the projection 122, having passed through the vertical guide path p1 according to a predetermined force applied by the user may gradually increase and be seated in the first seating groove p2 and be held with seated in the first seating groove p2. In other words, the projection 122 seated in the first seating groove p2 may be held with seated in the first seating groove p2 unless a predetermined force is applied thereto.

Therefore, the user may guide the grips 120 and 130 to be positioned at the correct position, and the grips 120 and 130 may be fixed with positioned at the correct position.

As illustrated in FIG. 10D, in another embodiment of the present disclosure, the insertion portion may further include a horizontal guide path p3 in addition to the vertical guide path p1 and the first seating groove p2 into which the projection 122 is inserted.

The horizontal guide path p3 may be extended from the first seating groove p2 in a rotation direction (i.e., a rotation direction about the Z axis) (hereinafter, a second direction) about the first direction.

In this case, the horizontal guide path p3 may be recessed at one side of the upper tub 221 and be recessed by a length smaller than a level in which the projection 122 is protruded from an outer side surface of the grip body 120. As a result, when the grips 120 and 130 mounted in the receptacle 220 rotate in a second direction, the horizontal guide path p3 may apply a pressure to the projection 122 in a radial direction of the grips 120 and 130 or in a direction on an XY plane so that the projection 122 is compressed to a predetermined ratio or more. Further, the horizontal guide path p3 may guide a sliding movement of the projection 122 in a second direction.

Accordingly, in order for the projection 122 to move into and pass through the horizontal guide path p3 after leaving the first seating groove p2, it is necessary for the user to apply a predetermined force in the second direction. Therefore, the user may rotate the grip 120 mounted in the receptacle 220 in the second direction and freely convert a discharge direction of the drying air from the discharge port 174 of the dryer to the left and right.

As illustrated in FIG. 10D, the insertion portion may further include a plurality of second seating grooves p4 in addition to the vertical guide path p1, the first seating groove p2, and the horizontal guide path p3 into which the projection 122 is inserted.

The plurality of second seating grooves p4 may be formed in a part of the horizontal guide path p3 and be disposed apart from each other by a predetermined distance together with the first seating groove p2.

In this case, the second seating groove p4 may be recessed at one side of the upper tub 221 and be recessed by a length greater than a level in which the horizontal guide path p3 is recessed. As a result, the second seating groove p4 may release at least some of a pressure applied to the projection 122 by the horizontal guide path p3. Further, the projection 122 may be seated in the second seating groove p4, and when the projection 122 is seated in each of a plurality of second seating grooves p4, the user may detect the seating in one of the second seating grooves p4.

Accordingly, the projection 122, having passed through the horizontal guide path p3 according to a predetermined force applied by the user may gradually increase and may be seated in the second seating groove p4 and be held with seated in the second seating groove p4. In other words, the projection 122 seated in the second seating groove p4 may be held with seated in the second seating groove p4 unless a predetermined force is applied thereto.

Accordingly, the user may rotate the grip 120 mounted in the receptacle 220 in the second direction and freely convert a discharge direction of the drying air from the discharge port 174 of the dryer to the left and right, and the grip 120 may be fixed at a plurality of points to be prevented from rotating unintentionally.

In summary, the vertical guide path p1, the horizontal guide path p3, the first seating groove p2, and the second seating groove p4 into which the projection 122 are inserted are recessed in a protruding direction of the projection 122, and a recessed level of the first and second seating grooves p2 and p4 may be greater than that of the vertical and horizontal guide paths p1 and p3.

Therefore, because a predetermined force is required for enabling the projection 122 seated in the first and second seating grooves p2 and p4 to be released to the outside of the receptacle 220 through the vertical and horizontal guide passes p1 and p3, the grip 120 may be prevented from being separated from the receptacle 220 during a posture change of the receptacle 220.

As illustrated in FIG. 10E, positioning units of each of the dryer 100 and the stand 200 according to this embodiment of the present disclosure may be understood as a combination example of the embodiments shown in FIGS. 10A and 10B above. That is, the positioning units of each of the dryer 100 and the stand 200 according to this embodiment of the present disclosure may be disposed to face each other when the grips 120 and 130 are positioned at the correct position.

The positioning units of each of the dryer 100 and the stand 200 according to this embodiment of the present disclosure may include first positioning units M11 and M12 and second positioning units M21 and M22 in which a magnetic force acts on each other similar to the embodiment shown in FIG. 10A. As an example, the first positioning units M11 and M12 and the second positioning units M21 and M22 may be magnets of mutually opposite polarities.

Further, the positioning units of each of the dryer 100 and the stand 200 according to this embodiment of the present disclosure may include a first positioning unit 121 and a second positioning unit p0 that are in contact with and coupled to each other similar to the embodiment shown in FIG. 10B. As an example, the first positioning unit 121 may be a protruding rib 121 as a protruding portion protruding outward, and the second positioning unit may be an insertion groove p0 as an insertion portion into which the protruding portion is inserted.

Therefore, in this embodiment of the present disclosure, a coupling force between the grips 120 and 130 and the receptacle 220 can increase and coupling stability thereof can be improved, compared to when only the arrangements of FIGS. 10A and 10B are provided. The present disclosure may be implemented in an example in which the embodiments of FIGS. 10C-10D is combined with the embodiment shown in FIG. 10A as well.

When the positioning unit of the above embodiment includes a magnet, the magnet may include at least one of a permanent magnet and an electromagnet. Here, the electromagnet is a magnet that is magnetized when an electric current flows and that returns to an original state that is not magnetized when an electric current is interrupted. Therefore, when the positioning unit is provided with the electromagnet, there is an advantage that coupling and coupling strength of the grips 120 and 130 and the receptacle 220 can be easily controlled according to whether an electric current is supplied and a supply amount of an electric current.

Further, as illustrated in FIG. 11, the electromagnet may include a plurality of magnetic pixels capable of adjusting respective polarities according to a predetermined control signal. Here, the magnetic pixel is a pole formed in one area, and one magnetic pixel may be an N-pole or an S-pole.

In this case, the home appliance 1 according to an embodiment of the present disclosure may further include a controller for controlling a polarity of each of a plurality of magnetic pixels. That is, the controller may adjust the number of magnetic pixels of mutually opposite polarities (hereinafter, the number of opposite magnetic pixels) between positioning units of each of the dryer 100 and the stand 200.

The controller may be implemented using at least one of application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, and electrical units for performing other functions.

For example, the controller may control to arrange N-pole magnetic pixels in a first area 1*a* of areas 1*a* and 1*b* in which the magnetic pixels of the first positioning units M11 and M12 are arranged. In this case, the controller may control to arrange S-pole magnetic pixels in a second area 2*a* of areas 2*a* and 2*b* in which magnetic pixels of the second positioning units M21 and M22 are arranged.

Therefore, in the first area 1*a* and the second area 2*a*, a magnetic force (attraction) acts between the first positioning units M11 and M12 and the second positioning units M21 and M22 and thus the grip 120 may be positioned and fixed at the correct position.

In this way, by adjusting the number of opposite magnetic pixels (i.e., adjusting an area where a mutual magnetic force acts), the controller may control coupling and a coupling force of the grip 120 and the receptacle 220.

For example, when the grip 120 is mounted in the receptacle 220, if it is determined that there is no posture change of the receptacle, the controller may control the number of opposite magnetic pixels to be the number of first pixels (first area 1*a*, 2*a*). Further, when the grip 120 is mounted in the receptacle 220, if it is determined that there is a posture change of the receptacle, the controller may control the number of opposite magnetic pixels to be the number of second pixels greater than the number of first pixels (first area 1*b*, 2*b*).

Thereby, in the case where there is a posture change of the receptacle 220, a coupling force of the grip 120 and the receptacle 220 increases and thus it is easily prevented that the grip 120 is separated from the moving receptacle 220, compared with the case where there is no posture change of the receptacle 220. Further, when there is no posture change of the receptacle 220, only power required to prevent the grip 120 from being separated from the fixed receptacle 220 is consumed, which is also advantageous from the viewpoint of energy saving.

A method of adjusting a coupling force between the grip 120 and the receptacle 220 by adjusting a polarity of each of the plurality of magnetic pixels as described above will be described with reference to FIG. 12. Each of steps constituting a control method to be described later may be performed through the controller.

As illustrated in FIG. 12, step S10 of turning on the positioning unit may be executed. Here, turning-on of the positioning unit may be understood as a preparatory step of magnetically coupling the grip 120 and the receptacle 220 when the grip 120 is mounted in the receptacle 220 by supplying a predetermined current to electromagnets provided in the positioning unit.

After step S10, step S20 of detecting a weight change of the receptacle 220 may be executed. Here, a weight of the receptacle 220 may vary depending on whether the grip 120 is mounted in the receptacle 220. In order to detect a weight change of the receptacle 220, the home appliance 1 according to an embodiment of the present disclosure may have a load cell that may detect a weight change of the receptacle 220.

After step S20, step S30 of determining whether the grip 120 is mounted in the receptacle 220 may be executed.

In step S30, if it is determined that the grip 120 is not mounted in the receptacle 220, the process may return to step S20. In step S30, if it is determined that the grip 120 is mounted in the receptacle 220, step S40 of detecting a posture change of the receptacle 220 may be executed. Here, the posture change of the receptacle 220 may be detected through a separate sensor, but may be detected depending on whether a control signal instructing a posture change of the receptacle 220 has been issued as described above.

After step S40, step S50 of determining whether there is no posture change of the receptacle 220 may be executed.

In step S50, if it is determined that the receptacle 220 is fixed without any posture change, the number of opposite magnetic pixels may be controlled to the number of first pixels (step S51). In step S50, if it is determined that there is a posture change of the receptacle 220, the number of opposite magnetic pixels may be controlled to the number of second pixels greater than the number of the first pixels (step S52).

After step S51 or S52, step S60 of determining whether the positioning unit is turned off may be executed. Here, turning off the positioning unit may be understood as a releasing step of releasing magnetic coupling between the receptacle 220 and the grip 120 by not supplying a predetermined current to an electromagnet provided in the positioning unit. Thereby, when the user carries the dryer 100 and dries an object to be dried or when there is no risk that the grip 120 mounted in the receptacle 220 is released from the receptacle 220, energy can be saved by cutting off unnecessary current supply.

In step S60, if it is determined that the positioning unit is turned off, the control method is terminated, and if it is determined that the positioning unit is not turned off, the control method may be returned to step S20.

In the foregoing description, a home appliance including a dryer according to the embodiment of the present disclosure has been described with reference to the accompanying drawings. However, it is to be understood that the present disclosure is not limited to the above-described embodiment, and that various changes and modifications within the scope of the present disclosure may be made without departing from the spirit and scope of the present disclosure.

According to the present disclosure, the following effects may be achieved.

First, as a grip of a dryer is mounted in a receptacle of a stand, a user can dry an object to be dried without holding the dryer.

Second, a mounting position can be easily guided to a predetermined position (hereinafter, a correct position) on a receptacle of a grip by a positioning unit. For this reason, a magnetic force can act between positioning units disposed in each of the grip and the receptacle, positioning units can be in contact with and coupled to each other, or positioning units can be in contact with and coupled to each other while a magnetic force acts therebetween.

Third, unless the user intends to remove the dryer from the stand, the grip can be prevented from being separated from a correct position by the positioning unit. For this reason, the positioning units of each of the dryer and the stand can be disposed to face each other when the grips are positioned at a correct position by a coupling force by a physical contact or a magnetic force (attraction) acting on each other.

Fourth, a coupling force between the grip and the receptacle can be easily adjusted. For this reason, when the positioning unit includes an electromagnet, by adjusting a current supplied to the electromagnet, intensity of a magnetic force acting between the positioning units of each of the dryer and the stand can be adjusted.

Fifth, a coupling force between the grip and the receptacle can be easily adjusted. For this reason, when the positioning unit includes an electromagnet having a plurality of magnetic pixels, by adjusting a polarity of each of the plurality of magnetic pixels, an area can be adjusted in which a magnetic force acts between the positioning units of each of the dryer and the stand.

Sixth, a coupling force between the grip and the receptacle can be easily adjusted according to presence or absence of a posture change of the receptacle. For this reason, when the positioning unit includes an electromagnet having a plurality of magnetic pixels, in the case in which there is a posture change of the receptacle, a polarity of each of the plurality of magnetic pixels can be adjusted so that an area where a magnetic force acts between the positioning units of each of the dryer and the stand is set to be large, compared with the case where there is no posture change of the receptacle. Therefore, in the case in which there is a posture change of the receptacle, a coupling force between the grip and the receptacle is increased and thus the grip can be easily prevented from being separated from the moving receptacle, compared with the case where there is no posture change of the receptacle. Further, in the case where there is no posture change of the receptacle, only power required to prevent the grip from being separated from the fixed receptacle is consumed, which is also advantageous from the viewpoint of energy saving.

Seventh, coupling between the grip and the receptacle can be smoothly implemented without additional energy consumption. For this reason, one of the positioning units of each of the dryer and the stand can include a protruding portion, and the other one thereof may include an insertion portion into which the protruding portion is inserted.

Eighth, as the protruding portion and the insertion portion included in the positioning units of each of the dryer and the stand are formed in a direction deviating from a discharge direction of the drying air, while the user holds the grip, the user can easily check a position of the protruding portion and/or the insertion portion.

Ninth, the grip can be prevented from separating from a predetermined path on the receptacle through coupling by a physical contact of the grip and the receptacle. For this reason, the protruding portion may include a protruding rib extended in a direction in which the grip is mounted in the receptacle, and the insertion portion may include an inserting groove into which at least a part of the protruding rib is inserted.

Tenth, the grip can be prevented from separating from a predetermined path or a point on the receptacle through coupling by a physical contact between the grip and the receptacle. For this reason, the protruding portion may include a projection of an elastic material, and the insertion portion may include a vertical guide path for guiding a sliding movement in a direction in which the grip of the projection is mounted in the receptacle and a first seating groove on which the projection is seated. Here, the projection is seated on the first seating groove in an original state (or a state close thereto) after being slid on the vertical guide path in a compressed state and thus unless a predetermined force is applied to the projection, the grip can be fixed on the receptacle.

Eleventh, the grip rotates in a rotating direction about a direction in which the grip is mounted in the receptacle without being separated from the receptacle and thus a discharge direction of the drying air can be freely adjusted. For this reason, the insertion portion may include a horizontal guide path for guiding a sliding movement in a rotation direction about a direction in which the grip of the projection is mounted in the receptacle.

Twelfth, the grip rotates in a rotation direction about a direction in which the grip is mounted in the receptacle and thus a drying air discharge direction can be freely adjusted, and the grip is fixed at a plurality of points, thereby being prevented from unintentionally rotating. For this reason, the insertion portion may include a plurality of second seating grooves formed in a part of the horizontal guide path and in which the projection is seated. Here, the projection is seated in either a first seating groove or a plurality of second seating grooves in an original state (or a state close thereto) after being slid on the horizontal guide path in a compressed state and thus unless a predetermined force is applied to the projection, the grip can be fixed on the receptacle.

What is claimed is:

1. A home appliance, comprising:

a dryer to discharge drying air, the dryer including:

a casing;

a fan located in the casing;

a heater located in the casing;

a grip connected to the casing; and a dryer positioner located at the grip; and a stand, the stand including:

a receptacle to detachably mount an end of the grip of the dryer; and a stand positioner located at the receptacle, the stand positioner cooperating with the dryer positioner when the grip is mounted in the receptacle to align the grip in a predetermined position, wherein the dryer positioner includes one of a protruding portion and an insertion portion disposed at one side of the grip, and the stand positioner includes an other of the protruding portion and the insertion portion disposed at one side of the receptacle to contact the dryer positioner when the grip is in the predetermined position, wherein the protruding portion includes a projection made of an elastic material, and wherein the insertion portion includes:

a first guide path extending in a first direction, the first guide path applying pressure to compress the projection as the projection moves along the first guide path; and a first seating groove connected to the first guide path, the projection being received in the first seating groove after moving along the first guide path such that at least a portion of an applied pressure to the projection is released.

2. The home appliance of claim 1, wherein a magnetic force is generated between the dryer positioner and the stand positioner.

3. The home appliance of claim 2, wherein the dryer positioner includes a first magnetic positioner located at one side of the grip, and wherein the stand positioner includes a second magnetic positioner located at one side of the receptacle to face the first magnetic positioner when the grip is in the predetermined position.

4. The home appliance of claim 3, wherein the first magnetic positioner is provided as a plurality of first magnetic positioners spaced apart from each other by a predetermined distance, and wherein the second magnetic positioner is provided as a plurality of second magnetic positioners spaced apart from each other by a predetermined distance.

5. The home appliance of claim 3, wherein the first and second magnetic positioners are magnets of mutually opposite polarities.

6. The home appliance of claim 3, wherein one of the first magnetic positioner and the second magnetic positioner is a magnet.

7. The home appliance of claim 6, wherein the magnet comprises one of a permanent magnet and an electromagnet.

8. The home appliance of claim 7, wherein the electromagnet comprises a plurality of magnetic pixels, each magnetic pixel having an adjustable polarity in response to a predetermined control signal.

9. The home appliance of claim 8, further comprising a controller configured to control a polarity of each magnetic pixel of the plurality of magnetic pixels, wherein the controller is configured to adjust a number of magnetic pixels to have one plurality of mutually opposite polarities.

10. The home appliance of claim 9, wherein the stand includes a base, wherein the receptacle is connected to the base such that the receptacle is movable relative to the base, and wherein the controller is configured to:

determine whether a position of the receptacle relative to the base has changed during mounting of the grip in the base;

when the position of the receptacle relative to the base has not changed during mounting of the grip in the base, set the number of pixels to a first number of pixels; and when the position of the receptacle relative to the base has changed during mounting of the grip in the base, set the number of pixels to a second number of pixels that is greater than the first number of pixels.

11. The home appliance of claim 1, wherein the protruding portion includes a protruding rib extending in a first direction, and wherein the insertion portion includes an insertion groove extending in the first direction to receive at least a portion of the protruding rib.

12. The home appliance of claim 1, wherein the insertion portion includes:

a second guide path extending in a second direction away from the first guide path, the second guide path applying pressure to compress the projection as the projection moves along the second guide path; and a plurality of second seating grooves located in a portion of the second guide path, the second seating grooves being spaced apart from each other by a predetermined distance.

13. The home appliance of claim 12, wherein the first guide path and the second guide path are recessed a first depth in a protruding direction of the projection, wherein the first seating groove and the second seating grooves are recessed a second depth in the protruding direction of the projection, and wherein the first depth is less than the second depth.

14. The home appliance of claim 1, wherein the dryer discharges air in a discharging direction, and wherein the protruding portion and the insertion portion are offset so as to not be aligned with the discharging direction.

* * * * *